US010515404B2

(12) United States Patent
Shah et al.

(10) Patent No.: US 10,515,404 B2
(45) Date of Patent: Dec. 24, 2019

(54) COMPUTER SYSTEM AND METHOD FOR CONDUCTING AUCTIONS OVER A COMPUTER NETWORK

(75) Inventors: Chirag Shah, London (GB); Alan Buxton, Hertfordshire (GB); Ivan Pazniak, Minsk (BY); Yauheni Belarusets, Brest (BY); Dariusz Gertych, Przemet (PL)

(73) Assignee: SBB BUSINESS SERVICES LTD., Chesham (GB)

( * ) Notice: Subject to any disclaimer, the term of this patent is extended or adjusted under 35 U.S.C. 154(b) by 1375 days.

(21) Appl. No.: 14/232,398

(22) PCT Filed: Jul. 13, 2012

(86) PCT No.: PCT/GB2012/051674
§ 371 (c)(1),
(2), (4) Date: May 16, 2014

(87) PCT Pub. No.: WO2013/008031
PCT Pub. Date: Jan. 17, 2013

(65) Prior Publication Data

US 2014/0289066 A1 Sep. 25, 2014

(30) Foreign Application Priority Data

Jul. 13, 2011 (GB) ..... 1112032.6
Nov. 10, 2011 (GB) ..... 1119422.2

(51) Int. Cl.
*G06Q 30/08* (2012.01)

(52) U.S. Cl.
CPC ..... *G06Q 30/08* (2013.01)

(58) Field of Classification Search
CPC ..... G06Q 30/0631
(Continued)

(56) References Cited

U.S. PATENT DOCUMENTS 6,892,186 B1 * 5/2005 Preist ..... G06Q 30/08 705/26.3
7,571,131 B1 * 8/2009 Lewis ..... G06Q 10/0833 705/37
(Continued)

FOREIGN PATENT DOCUMENTS

EP 0 900 424 10/1997
EP 1 012 764 8/1998
(Continued)

OTHER PUBLICATIONS

International Search Report, dated Sep. 27, 2012, issued in priority International Application No. PCT/GB2012/051674.

*Primary Examiner* — Alexis M Casey
(74) *Attorney, Agent, or Firm* — Sheppard Mullin Richter & Hampton LLP

(57) ABSTRACT

There is provided a computer system for conducting auctions over a computer network, comprising: a posting system operable to post on the computer network information describing each lot of a plurality of lots that are available for bidding by a plurality of bidders, each lot including at least one item; a bid receiving system for receiving a bid relating to at least a portion of a lot of the plurality of lots, characterized in that the posting system is operable to define an n-dimensional matrix, where n is at least 2, wherein the matrix comprises the plurality of lots, and wherein the posting system is operable to post the matrix on the computer network. A computer-implemented method relating to the computer system, and a computer-readable medium containing instructions for implementing the computer-implemented method, are also provided.

17 Claims, 22 Drawing Sheets

(58) Field of Classification Search
USPC ..... 705/26.7
See application file for complete search history.

(56) References Cited

U.S. PATENT DOCUMENTS

| | | | | |
|---|---|---|---|---|
| 8,015,101 | B2 * | 9/2011 | Feaver | G06Q 30/06 705/36 R |
| 8,131,732 | B2 * | 3/2012 | Yu | G06F 17/16 707/748 |
| 8,880,439 | B2 * | 11/2014 | Archambeau | G06N 99/005 706/12 |
| 9,213,767 | B2 * | 12/2015 | Scholz | G06F 17/3071 |
| 2003/0115127 | A1 * | 6/2003 | Delbarba | G06Q 30/08 705/37 |
| 2005/0182706 | A1 * | 8/2005 | Shimizu | G06Q 30/08 705/37 |
| 2005/0228736 | A1 * | 10/2005 | Norman | G06Q 30/08 705/37 |
| 2006/0277167 | A1 * | 12/2006 | Gross | G06F 17/30864 |
| 2007/0237493 | A1 * | 10/2007 | Hall | G06F 17/30064 386/240 |
| 2009/0125543 | A1 * | 5/2009 | Patil | G06F 17/30595 |
| 2009/0299996 | A1 * | 12/2009 | Yu | G06F 17/30867 |
| 2010/0076960 | A1 * | 3/2010 | Sarkissian | G06F 17/30867 707/722 |
| 2010/0293184 | A1 * | 11/2010 | Josifovski | G06Q 30/02 707/769 |
| 2011/0161354 | A1 * | 6/2011 | Ma | G06F 17/30991 707/769 |
| 2011/0314031 | A1 * | 12/2011 | Chittar | G06F 17/3025 707/749 |
| 2012/0030159 | A1 * | 2/2012 | Pilaszy | G06Q 10/00 706/46 |
| 2012/0059788 | A1 * | 3/2012 | Sekino | G06Q 10/101 706/52 |

FOREIGN PATENT DOCUMENTS

| | | | | |
|---|---|---|---|---|
| EP | 1 085 439 | A1 | 3/2001 | |
| EP | 1085439 | A1 * | 3/2001 | G06Q 30/08 |
| EP | 1400902 | A1 * | 3/2004 | G06F 17/30651 |
| WO | 97/37315 | | 10/1997 | |
| WO | 98/34187 | | 8/1998 | |
| WO | 2004/081828 | A2 | 9/2004 | |
| WO | WO-2004081828 | A2 * | 9/2004 | G06Q 30/08 |
| WO | WO-2009129659 | A1 * | 10/2009 | G06F 17/30991 |

* cited by examiner

| *Categories* | *Groups* | |
|---|---|---|
| | USA | Europe |
| Wines | Yes | Yes |
| Beers | Yes | No |

FIGURE 1

| *Categories* | *Items* | *Groups* | |
|---|---|---|---|
| | | USA | Europe |
| Wines | Sauvignon Blanc | Yes | Yes |
| | Malbec | No | Yes |
| | Merlot | Yes | Yes |
| Beers | Lager | Yes | [redacted] |
| | Ale | Yes | |

FIGURE 2

| | USA | Europe | China |
|---|---|---|---|
| Engineering | | | |
| Underground Construction | | | |
| Aerial Construction | | | |

FIGURE 3

| | Spain | England | France | Germany |
|---|---|---|---|---|
| Trench Digging | | | | |
| Boring | | | | |
| Manhole Placement | | | | |

FIGURE 4

| | | | London | | | Paris | | |
|---|---|---|---|---|---|---|---|---|
| Category | Item | Price per box | # Boxes | Delivery per box | Total bid | # Boxes | Delivery per box | Total bid |
| Pens | Blue biros | 10 | 150 | 1 | = (10 +1) * 150 | 200 | 4 | =(10 + 4) * 200 |
| | Red biros | 20 | 150 | 1 | =(20 + 1) * 150 | 100 | 4 | =(20 + 4) * 100 |
| Pencils | HB | 40 | 300 | 2 | Etc | 400 | 3 | |
| | 2B | 30 | 300 | 2 | Etc | 300 | 3 | |

FIGURE 5

Search for your trip

Flights
Flight + Hotel
Hotels
Package holidays >
Cars

Return
One way
Multi-stop flights >

From
London Heathrow Apt, London, Uni

To
Athens Eleftherios Venizelos Intl A

Departing
11 November 2011 Fri
View Calendar >
Any time

Returning
18 November 2011 Fri
View Calendar >
Any time

Are you flexible by +/- 1 day?
Direct flights only

Class
Any

Airline
No Preference
Include low-cost airlines

Adults
1

Children (2-11)
0

Infant (1 per adult)
0

Search

FIGURE 11

| Client Web Browser | Application Server | Push Server | Background Job processor |
|---|---|---|---|
| Initiates request via a search box | | | |
| | Save search criteria return search id to client | | |
| Subscribes to update server on a channel for this search id. Also send request which enqueue search. | | | |
| | Enqueue search - Initiates background high-level search job | | |
| | | | Begins an initial high-level search to return up to 100 initial company results |
| | | | Notifies push server of initial search results |
| | | Pushes updates to the client | |
| Client app respond on new data and facet filters results and updates screen. | | | |
| | | | Starts downloading and indexing each company record that is considered "stale" (i.e. not changed in > x days) |
| | | | Continues searching as long as there are more high-level results to be retrieved |
| Selects some high-level facet | | | |
| | Search is updated | | |
| | | | Pending company searches that are no longer needed are cancelled |

FIGURE 14

| Client Web Browser | Application Server | Local search engine | Push Server | Background Job processor |
|---|---|---|---|---|
| Initiates request via a search box | | | | |
| | Save search criteria return search id to client | | | |
| Subscribes to update server on a channel for this search id.. | | | | |
| | Subscription triggers:<br>(1) Enqueue background tasks responsible for searching 3rd party APIs<br>(2) Initiate a search of locally-stored information (which may not be complete) | | | |
| | | Returns local search results with custom facet structure | | Begins processing enqueued tasks to call 3rd party APIs<br><br>Additionally begin re-downloading and indexing locally any individual record that is considered stale (last checked within the previous X days). Each company update |
| | | | | routine is run in its own unique background job. |
| | Results from background job are parsed, unified and passed to the local search engine | | Pushes local search results to clients. | |
| | | Indexes the newly-provided data | Pushes newly indexed data from remote sources to clients | Continues searching as long as there are more results to be retrieved or the search is cancelled by the user |
| Browser reacts to push of new data and updates search results and facets | | | | |
| User modifies one or more facets and/or search criteria | Updates conditions for query and facets.<br>Restarts the local and remote search | | | Pending company searches that are no longer required are cancelled |

FIGURE 21

COMPUTER SYSTEM AND METHOD FOR CONDUCTING AUCTIONS OVER A COMPUTER NETWORK

CROSS REFERENCE TO RELATED APPLICATIONS

This application claims the priority of PCT/GB2012/051674, filed on Jul. 13, 2012, which claims priority to Great Britain Application No. 1112032.6, filed Jul. 13, 2011, and Great Britain Application No. 1119422.2, filed Nov. 10, 2011, the entire contents of each of which is fully incorporated herein by reference.

BACKGROUND OF THE INVENTION

1. Field of the Invention

The field of the invention relates to computer systems for conducting auctions over a computer network, and to methods for conducting auctions over a computer network.

2. Description of the Prior Art

Traditional negotiation platforms allow the host to create a one-dimensional list of lots and/or items for bidders to bid on.

In negotiations, there are existing algorithms that will allow a host to convert non-price attributes into cash terms and/or convert price bids into non-price scores. However these algorithms are poorly understood by potential users with the result that they are underutilised.

In general a faceted search requires the server to return all relevant data first, and then allows the user to select from different facets.

3. Discussion of Related Art

In EP0900424B1, there is provided a system and method for conducting a multi-person, interactive auction, in a variety of formats, without using a human auctioneer to conduct the auction. The system is preferably implemented in software. The system allows a group of bidders to interactively place bids over a computer or communications network. Those bids are recorded by the system and the bidders are updated with the current auction status information. When appropriate, the system closes the auction from further bidding and notifies the winning bidders and losers as to the auction outcome.

In EP1012764B1, which includes the disclosure of prior art FIG. 20, there is provided a method of holding auctions which take place in a computer environment, where a plurality of sellers (2) and bidders (3) may submit bids from local computers to a central computer (1), a so-called server which may e.g. be coupled via the Internet. The server (1) may offer a catalogue (5) to the individual bidders (3) who can then prepare, via their own computers, a prioritized list of the articles which they may possibly desire to buy. The auctioning system incorporates the certainty, via a list of purchase conditions, that a bidder does not risk buying too many articles, or that he will not spend too much money, in the same manner as is known from a traditional live auction. It is moreover noted that the auctioning system may be combined with an ordinary live auction. The auctioning form gives a very advantageous price formation which considers both sellers' and buyers' interests. Furthermore, the auction may take place entirely without geographical limitations.

As disclosed in EP1012764B1, in prior art FIG. 20 the numeral 1 designates a central computer, a so-called auction server, from which an auction is controlled. The central computer has data connections to a plurality of sellers 2 and a plurality of bidders 3. As additionally disclosed in EP1012764B1, in prior art FIG. 20 the central computer 1 has a catalogue storage 5 which contains information on the articles to be auctioned. Also included are a bid packages storage 6 containing information on the possible bids of each individual bidder, a bid storage 7 for submitting bids to the central computer, and a storage 8 for storing and submitting the auction results.

SUMMARY OF THE INVENTION

According to a first aspect of the invention, there is provided a computer system for conducting auctions over a computer network, comprising:

a posting system operable to post on the computer network information describing each lot of a plurality of lots that are available for bidding by a plurality of bidders, each lot including at least one item;

a bid receiving system for receiving a bid relating to at least a portion of a lot of the plurality of lots, characterized in that the posting system is operable to define an n-dimensional matrix, where n is at least 2, wherein the matrix comprises the plurality of lots, and wherein the posting system is operable to post the matrix on the computer network.

The computer system may be one wherein the posting system is operable to post the matrix on the computer network in that the posting system is operable to make the matrix available for display on screens of computers in the computer network.

The computer system may be one wherein the bid receiving system is operable to receive a plurality of bids relating to a plurality of lots in the matrix.

The computer system may be one wherein $n \geq 3$, and the matrix comprises sub-matrices of dimension $m<n$, and the results of related sub-matrices of dimension $m<n$ are aggregatable upwards through an arbitrary number of levels, each structured in a matrix format.

The computer system may be one wherein $n \geq 3$, and the cells in a top level of the matrix presented on a computer screen are expandable to present a sub-matrix of dimension $p<n$.

The computer system may be one wherein $n \geq 4$, and the cells in a top level of the matrix presented on a computer screen are expandable to present a sub-matrix of dimension $q<(n-1)$.

The computer system may be one wherein a 3-level nested matrix setup is provided on a computer screen, and each cell in this setup is expandable to represent results from one matrix negotiation.

The computer system may be one wherein the posting system is operable to add multiple attributes to an element of the matrix.

The computer system may be one wherein results from each matrix negotiation functions as an independent negotiation.

The computer system may be one wherein $n=2$, and the two dimensions relate to product categories and to groupings.

The computer system may be one wherein the bidding system is operable to receive bids for different levels of the matrix.

The computer system may be one wherein the bidding system is operable to download all relevant data for negotiation for a bidder to consider and update their bids offline and then re-upload.

The computer system may be one including an auction server hosting the bid receiving system, the posting system, and a lot storage.

According to a second aspect of the invention, there is provided a computer-implemented method of conducting auctions over a computer network, the method comprising the steps of:

(i) defining an n-dimensional matrix, in which n is at least 2, wherein the matrix comprises a plurality of lots, each lot including at least one item, (ii) posting the matrix on the computer network, the matrix including information describing each lot of the plurality of lots that are available for bidding by a plurality of bidders, and (iii) receiving a bid relating to at least a portion of a lot of the plurality of lots.

The method may be one wherein the step of defining an n-dimensional matrix is performed on a posting system.

The method may be one wherein the step of posting the matrix on the computer network includes the posting system making the matrix available for display on screens of computers in the computer network.

The method may be one wherein the step of receiving a bid includes receiving a bid at a bid receiving system.

The method may be one wherein the step of receiving a bid includes receiving a plurality of bids relating to a plurality of lots in the matrix.

The method may be one wherein $n \geq 3$, and the matrix comprises sub-matrices of dimension $m<n$, and the results of related sub-matrices of dimension $m<n$ are aggregatable upwards through an arbitrary number of levels, each structured in a matrix format.

The method may be one wherein $n \geq 3$, and the cells in a top level of the matrix presented on a computer screen are expandable to present a sub-matrix of dimension $p<n$.

The method may be one wherein $n \geq 4$, and the cells in a top level of the matrix presented on a computer screen are expandable to present a sub-matrix of dimension $q<(n-1)$.

The method may be one wherein a 3-level nested matrix setup is provided on a computer screen, and each cell in this setup is expandable to represent results from one matrix negotiation.

The method may be one including the step of adding multiple attributes to an element of the matrix.

The method may be one including the step of receiving bids for different levels of the matrix.

The method may be one including the step of downloading all relevant data for negotiation for a bidder to consider and update their bids offline and then re-upload.

According to a third aspect of the invention, there is provided a computer-readable medium containing instructions for conducting auctions over a computer network through steps comprising:

(i) defining an n-dimensional matrix, in which n is at least 2, wherein the matrix comprises a plurality of lots, each lot including at least one item, (ii) posting the matrix on the computer network, the matrix including information describing each lot of the plurality of lots that are available for bidding by a plurality of bidders, and (iii) receiving a bid relating to at least a portion of a lot of the plurality of lots.

BRIEF DESCRIPTION OF THE DRAWINGS

FIG. 1 shows a simple example of a two-dimensional matrix across product categories and territorial groups.

FIG. 2 shows an example in which the categories of FIG. 1 have been expanded to show the items contained.

FIG. 3 shows an example of a top-level matrix in a 3-level nested matrix setup.

FIG. 4 shows an example in which the "Europe—Underground Construction" of FIG. 3 has been expanded.

FIG. 5 shows an example in which bidders enter values in the fields highlighted as white text on a black background.

FIG. 11 shows an example of entering search criteria.

FIG. 14 shows an example of a multi-phased faceted search.

FIG. 21 shows an example of a multi-phased faceted search.

DETAILED DESCRIPTION

Matrix Design Online Negotiations

Negotiation Format

Figure 6:
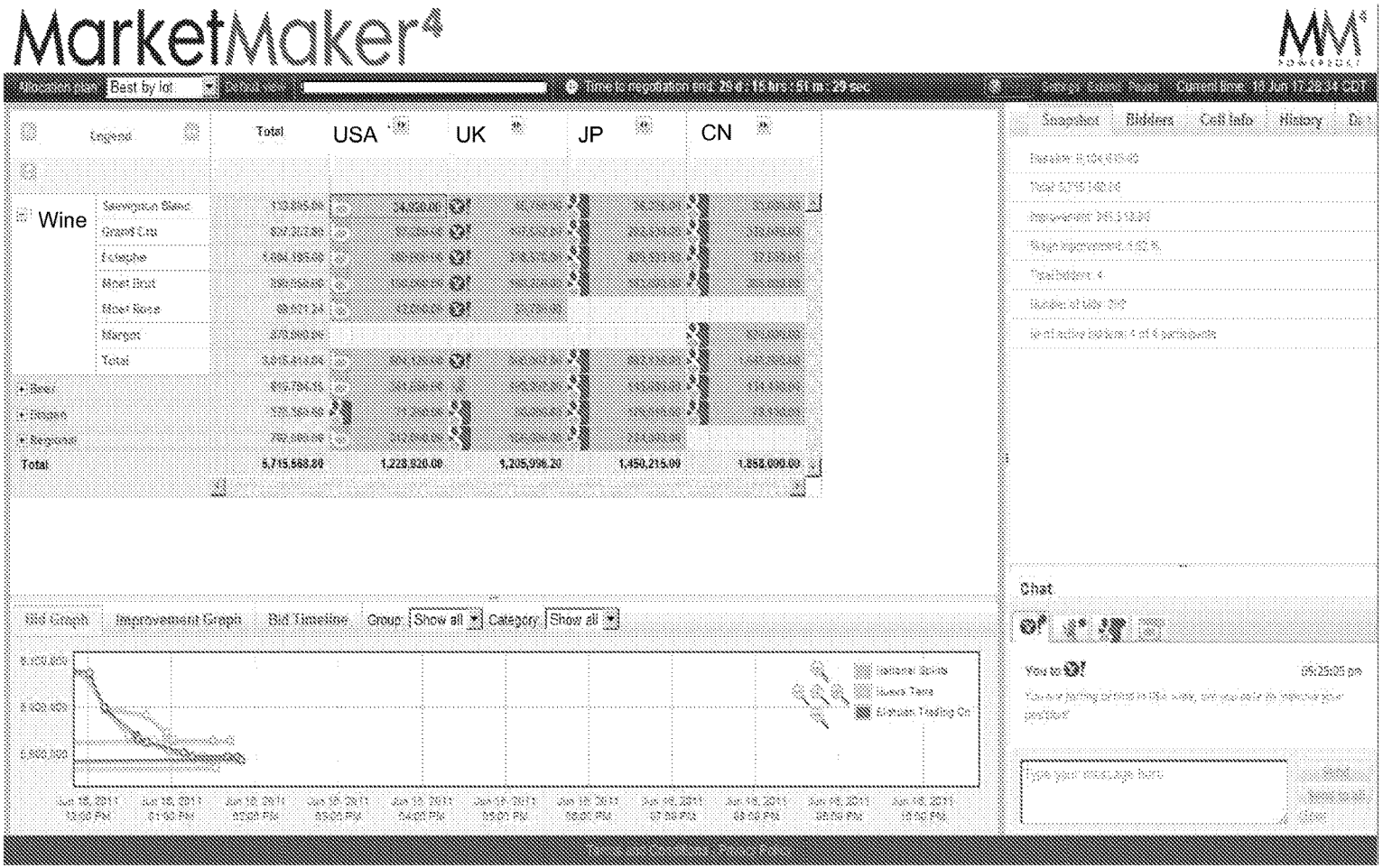
FIG. 6 shows a screen example of a user interface of a negotiation platform.

Traditional negotiation platforms allow the host to create a one-dimensional list of lots and/or items for bidders to bid on. However in many cases it would be more effective to design online negotiations in an n-dimensional matrix (in which n is greater than or equal to 2) as this would facilitate:

Best bid analysis during the live online negotiation

Allowing bidders to bid on a larger number of items online than has generally been the case in the past.

A simple example would be a two-dimensional matrix across product categories and territorial groups, for example see FIG. 1. This matrix contains 2 categories (wines & beers) across 2 groups (USA and Europe). The intersection of a category and a group is a lot. Each category is represented on the y axis in this example and may contain 0 or more individual line items. For example we could expand both categories above to show the items contained. See FIG. 2 for example. Each intersection of an item within a lot is called a cell. In this example the Wines-USA lot contains 2 active cells for Sauvignon Blanc and Merlot.

Each item can have multiple attributes added by the host—for example: 0 or more images, colour, weight, document attachments, size, unit of measure, description, reference number etc.

In the examples of FIGS. 1 and 2 the groups are defined as territories but groups can also be used to cover any number of different "groupings" that relate to the items, for example:

Service levels

Product types

Etc.

In an n-dimensional matrix the host would define categories and their constituent items as above and would then define 1 or more group types, each group type containing one or more groups. In an example, n=3. In another example, n=4. In another example, n≥3. In another example, n≥4.

This kind of negotiation design can equally be used in a sales or a procurement environment (forward auction, reverse auction, even in a multi-directional auction where different groups/categories can move upwards or downwards).

"Books": Nested Matrices

Where the size of a matrix is large (thousands or tens of thousands of cells) it is useful to be able to break down the overall matrix into a number of constituent parts. In this design the most granular level of matrix is called a "book". Each "book" is its own matrix as described above. The results of related books are aggregated upwards through an arbitrary number of levels, each structured in a matrix format.

For example a 3-level nested matrix setup could be set up as follows. A Top level is shown for example in FIG. 3. "Europe—Underground Construction" may then expand to become as shown for example in FIG. 4, with each of the cells at this level representing the results from one matrix negotiation (aka Book).

In nested matrices each book functions as an independent negotiation. The higher level nestings are populated with "Bidder statistics" and "Host statistics". These statistics can be customized according to the specific requirements but typically might be as follows:

Bidder: Total bid, Total best bid or Total bid, Average Rank

Host: Baseline total, Best bid total, Number of bids

Bidding

Bidders can provide bids at different levels:

Across the whole negotiation

Across all groups for an item

Across all groups within a group type for an item

Across all items for a group

Within a cell

Bids can use any formula. A simple example is shown in FIG. 5. Bidders enter values in the fields highlighted as white text on a black background.

It is easy to imagine other bid elements, for example there might be a setup fee that could differ per location.

Bid elements do not have to be numeric. They can also be text fields such as a part number or a comment from the bidder.

In this type of dynamic online negotiation bidders may be required to bid on hundreds or even thousands of cells. To simplify this process the matrix design negotiation platform provides the following features:

1. All bidders must enter reserve bids for each item that they intend to bid on. This is the amount beyond which they do not wish to bid. Reserves can be modified during the live negotiation if needed. Based on these reserves we are able to:

a. identify the cell on which the bidder has the greatest margin, and therefore the cell in which they can make the biggest change while retaining the maximum margin.

b. Identify the lot on which the bidder has the greatest margin c. Identify the lot that, if the bidder were leading on it, would add the greatest amount of net margin to the bidder's benefit.

d. Auto-bid on behalf of the bidder (see below).

2. We can also identify the lot which, if the bidder were leading on it, would add the largest amount of overall value to their total set of leading lots.

3. Providing cell-level and lot-level leading competitor information. The following types of competitor information can be shown: best bid, rank, quartile rank, target price, absolute floor, absolute ceiling, market average, weighted average or any other similar calculation. Alternatively or additionally, bid information can be provided.

4. Providing colour-coding on the bidder's relative position.

a. Green=leading bid b. Amber=close—the host can configure the level at which a bid would go amber (e.g. up to 3% behind the leading bid)

c. Red=far—the level at which a bid goes red is also configurable by the host (e.g. from 10% behind the leading bid)

5. These reserves are not hard limits (except in the case of auto bidding as described below). During interactive or mass bidding the bidder can place whatever bids she likes—however a colour coding is applied to indicate any cells where the bidder has gone beyond her reserve.

One problem in traditional online auctions is that bidders take part without the intent to compete aggressively. They just watch the negotiation unfold, find out where the final bid price ended up and then attempt to negotiate afterwards with the auction host. The solution has typically been to allow the host to exclude bidders. In the matrix design negotiation bidders are only able to see competitor information if they are within x % of the leading bid, where x is configurable by the host.

Auto Bidding

Where bidders are bidding on many items at a time it may be more convenient for the system to auto bid on their behalf. In contrast to other auction platforms our auto-bid functionality allows the following options for bidders:

1. Keep bidding for first place: This version is the common approach used in Ebay, for example in which the system will continue placing leading bids during the live auction up until the bidder's limit is reached.

2. One-shot bid to lead: In this option the bidder still retains active control of his bids. The system will make one single attempt to lead in any items where the bidder can achieve first place without going beyond his reserves. But once this one single bidding attempt has been completed, the bidder is expected to review the results and then continue his bidding strategy—whether this is to bid interactively 3. Keep bidding as competitively as possible: In this scenario the system will continue to bid as aggressively as possible to gain first place, or even to simply offer as good a bid as possible without necessarily gaining the lead.

4. One-shot bid to become as competitive as possible: This is equivalent to a combination of (2) and (3) above.

Mass Bidding

The nature of the matrix structure lends itself well to downloading all the relevant data for the negotiation for a bidder to consider and update their bids offline and then re-upload. The data is downloaded into one spreadsheet that can then be re-uploaded.

Once re-uploaded the system provides a report of which bids were placed successfully and which failed (e.g. they may have failed validation). This information is persisted for future reference if needed.

Live Negotiation Hosting

Negotiation hosts are also faced with a large volume of data to manage during a matrix design negotiation. While standard features are included (e.g. extensions, chat, graphing, online/offline indicators for bidders) in addition two major features are provided to facilitate online event management.

Real-Time Customisable Allocation Plan Comparisons

Usually hosts leave the analysis of auction results until after the auction has completed. Different allocation plans the host might want to use are for example:

Award each lot to the best bidder

Award each individual item to the best bidder

Award as much as possible to incumbents

Award overall to the fewest possible bidders

Award x % to minority bidders

The matrix design negotiation allows hosts to compare different allocation plans live during the event. Whenever a new bid arrives and an allocation plan is requested a snapshot of the data is taken and the relevant portion of the allocation plan is recalculated. The resulting data is not persisted and is only cached in memory for fast access and on the basis that the allocation plan is likely to become obsolete when the next bid is received.

Lot & Cell Level Bid Coverage

Background colour coding is used to indicate how long since a bid was placed on a particular cell or lot. Colour coding is customisable as follows:

Pink—cell/lot has been bid on recently (e.g. <30 seconds)

Orange—cell/lot is active but has not had a recent bid (e.g. 30 seconds <last bid <10 minutes)

Light blue—cell/lot has had light activity (e.g. 10 minutes<last bid)

Dark blue—cell/lot has not been bid on yet

The timings are customisable by the host

Real-Time Updates

The Matrix design negotiation relies on pushing near real-time updates with a fallback to regular timed page refreshes where real-time updates are not possible due to a lost connection to the update server. A minimally consistent set of data is sent to each subscribing client on request. The Matrix Design Negotiation Server (MDNS) pushes out updates to notify clients that they should request an update.

Real time updates are handled as follows from the point of view of a bidder submitting a new bid. Assuming the new bid is validated and stored into the database the following steps occur:

1. The bidder receives a confirmation that the bid was received. His bid is marked as "awaiting update" on his screen 2. The MDNS pushes a notification of the new bid receipt to subscribing parties.

a. Subscribing parties (i.e. host, co-hosts/observers and other bidders) display the new bid notification according to their access level: bidders are only notified of new leading bids, not all new bids 3. Subscribing parties make requests to update graphs and history a. Hosts update their graphs and history on each bid b. Bidders only update their own history when they place a bid 4. The bid data is queued a. If there is no allocation plan calculation in process then a new allocation plan calculation is launched b. When the current allocation plan calculation for this negotiation completes, if there is data in the bid queue, then a new allocation plan calculation is kicked off 5. Once the allocation plan(s) is/are calculated the MDNS pushes a notification to all subscribers that there is a requirement to update their matrix screens a. Subscribers receive the notification and request an update of the new values to display in the matrix (together with colour codings), new guidance values, new summary negotiation information, and any information relating to any specific cell the subscriber is currently viewing.

b. On receiving the new data the clients re-render the relevant parts of their screens c. At the same time each client makes a separate request to the MDNS to request the history of bids made since the latest bid stored on the client. The subscribing client can then update its negotiation history.

It is important to note that all the above steps happen asynchronously and can happen in any order.

In order to speed up the calculation of allocation plans, only the relevant portion of any allocation plan is recalculated during a single run.

Bidder and Host statistics are continuously generated on a cycle. They can also be refreshed on demand. Mass bidding downloads are continuously regenerated on a cycle. Bidders can also recreate their mass bidding download on demand.

Real-Time Updates: An Alternative

The Matrix design negotiation relies on pushing real-time updates with a fallback to regular timed page refreshes where real-time updates are not possible due to a lost connection to the update server. A minimally consistent set of data is sent to each subscribing client on request. The Matrix Design Negotiation Server (MDNS) pushes out updates to notify clients that they should request an update.

Real time updates are handled as follows from the point of view of a bidder submitting a new bid. Assuming the new bid is validated and stored into the database the following steps occur:

1. The MDNS responds to the client that the update was successful and instructs the bidder's client to re-render the matrix (showing the current state of competitive bids)

2. The MDNS pushes a notification of the new bid receipt to subscribing parties.

a. Subscribing parties (i.e. host, co-hosts/observers and other bidders) display the new bid notification according to their access level: bidders are only notified of new leading bids, not all new bids 3. The MDNS pushes a notification to all subscribers that there is a requirement to update their matrix screens a. Subscribers receive the notification and request an update of the new values to display in the matrix (together with colour codings), new guidance values, new summary negotiation information, and any information relating to any specific cell the subscriber is currently viewing.

b. On receiving the new data the clients re-render the relevant parts of their screens c. At the same time each client makes a separate request to the MDNS to request the history of bids made since the latest bid stored on the client. The subscribing client can then update its negotiation history.

It is important to note that all the above steps happen asynchronously and can happen in any order.

User Interface

Figure 7:
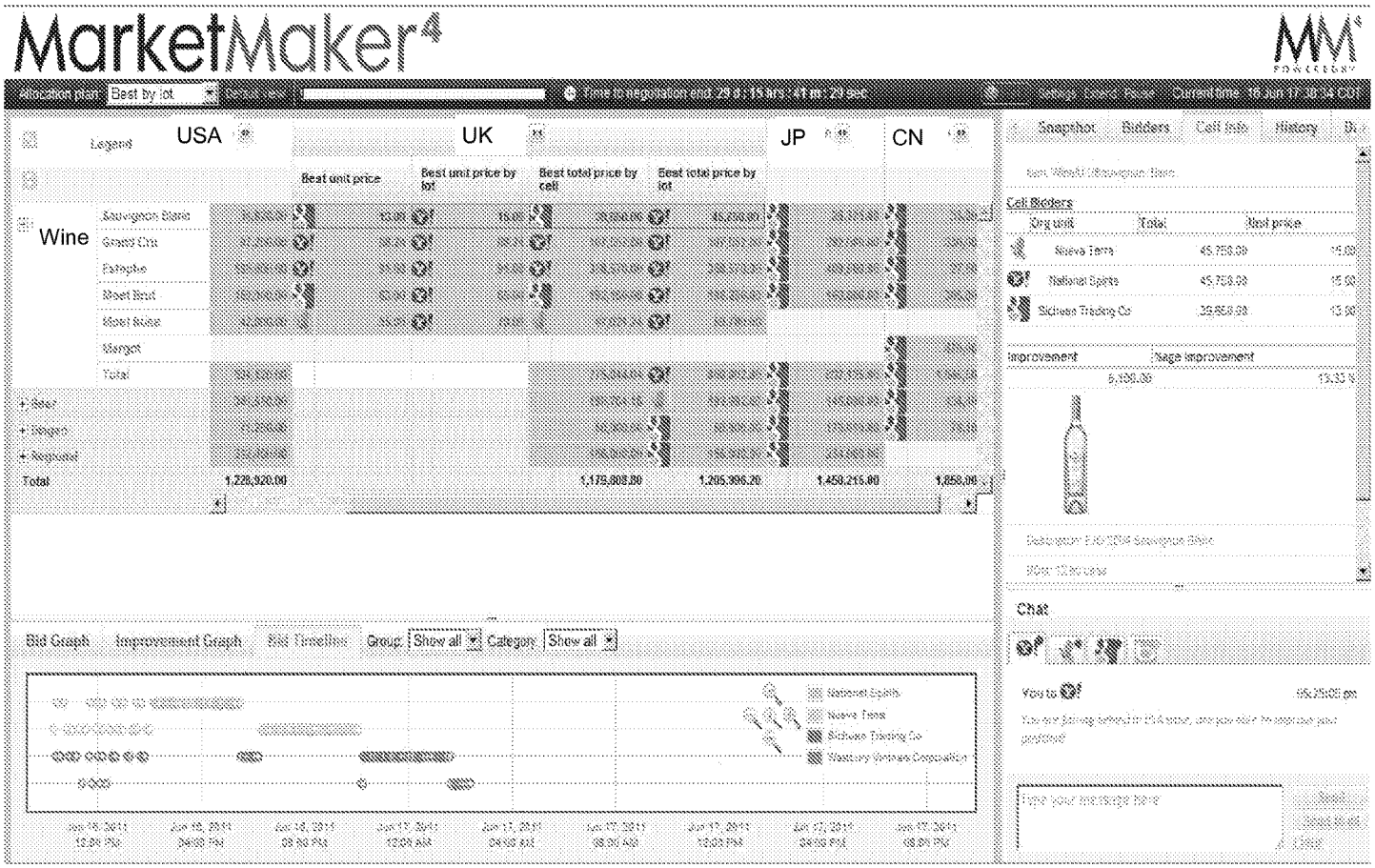
FIG. 7 shows a screen example of a user interface of a negotiation platform.
Figure 8:
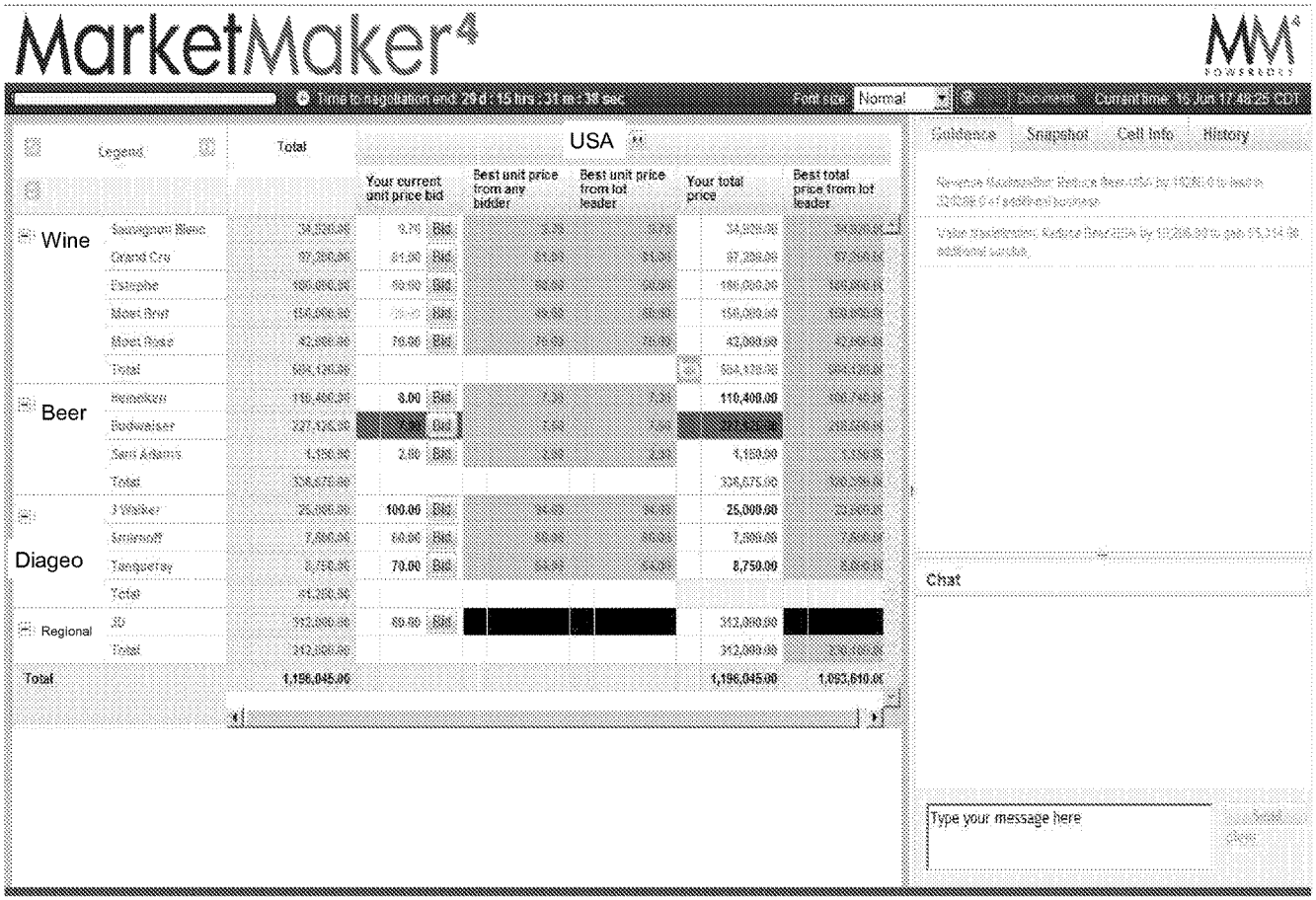
FIG. 8 shows a screen example of a user interface of a negotiation platform.

Screen Examples are shown in FIGS. 6 to 8.

FIG. 6 shows a screen example of a user interface of a negotiation platform. In FIG. 6, the "Wine" cell has been expanded vertically to list multiple types of wine on which bids may be placed. Hence cells are expandable vertically to list categories which correspond to a given cell. In a more general case, cells are expandable in one dimension to list categories which correspond to a given cell. In the example of FIG. 6, the screen shows a time to negotiation end, the selected allocation plan ("Best by lot" in this example), and selectable Snapshot, Bidders, Cell Info and History tabs for providing respective information. The screen also shows a Bid Graph, which shows bids from various bidders as a function of time. The tabs Improvement Graph and Bid Timeline are also provided for user selection. The screen also includes a Chat region, in which messages can be input and sent to other users, and messages can be received from other users and displayed on the screen.

FIG. 7 shows a screen example of a user interface of a negotiation platform. In FIG. 7, the "UK" cell has been expanded horizontally to list multiple types of price information based on the bids received. In this example, the multiple types of price information are: best unit price, best unit price by lot, best total price by cell, and best total price by lot. Hence cells are expandable horizontally to list multiple types of price information based on the bids received, which correspond to a given cell. In a more general case, cells are expandable in one dimension to list multiple types of price information based on the bids received, which correspond to a given cell. In another general case, some cells are expandable in one dimension to list categories which correspond to a given cell, and other cells are expandable in another dimension to list multiple types of price information based on the bids received, which correspond to a given cell. In the example of FIG. 7, a bid timeline tab has been selected. This shows occurrences of bids placed by a number of bidders, as a function of time. In the example of FIG. 7, the Cell Info tab has been selected. The bidders are shown which correspond to selected cells, where the cells correspond to Wine/UK/Sauvignon Blanc in this example. Three bidders are shown, as well as their respective totals and unit prices. An improvement amount of money, and a percentage improvement, are calculated and displayed.

FIG. 8 shows a screen example of a user interface of a negotiation platform. In FIG. 8, the items cells "Wine", "Beer", "Diageo" and "Regional" have been expanded vertically to list multiple types of corresponding items on which bids may be placed. Hence cells are expandable vertically to list categories which correspond to a given cell. In a more general case, cells are expandable in one dimension to list categories which correspond to a given cell. In FIG. 8, the "USA" cell has been expanded horizontally to list multiple types of price information based on the bids received. In this example, the multiple types of price information are: your current unit price bid, best unit price from any bidder, best unit price from lot leader, your total price, and best total price from lot leader. Hence cells are expandable horizontally to list multiple types of price information based on the bids received, which correspond to a given cell. In a more general case, cells are expandable in one dimension to list multiple types of price information based on the bids received, which correspond to a given cell. Hence in FIG. 8, some cells are expandable in one dimension to list categories which correspond to a given cell, and other cells are expandable in another dimension to list multiple types of price information based on the bids received, which correspond to a given cell.

Preference Design Online Negotiations

DESCRIPTION

Preference negotiations address the deficiencies of multi-attribute and weighted auctions. There are existing algorithms that will allow a host to convert non-price attributes into cash terms and/or convert price bids into non-price scores. However these algorithms are poorly understood by potential users with the result that they are underutilised.

Preference negotiations offer an alternative. Preference negotiations are multi-round negotiations in which the host picks, arbitrarily, the preferred overall package. The elements of the preferred overall package are communicated back to the competing bidders who are then able to modify their bids in the next round.

Direction is irrelevant in preference design negotiations as bidders simply need to attempt to improve on their previous bid in whatever way they choose.

Bidders can suggest new attributes at any time.

Hosts can accept or reject suggested attributes, and can even edit attributes and bidder responses on behalf of those bidders. All such changes are logged in an audit trail.

Figure 9:
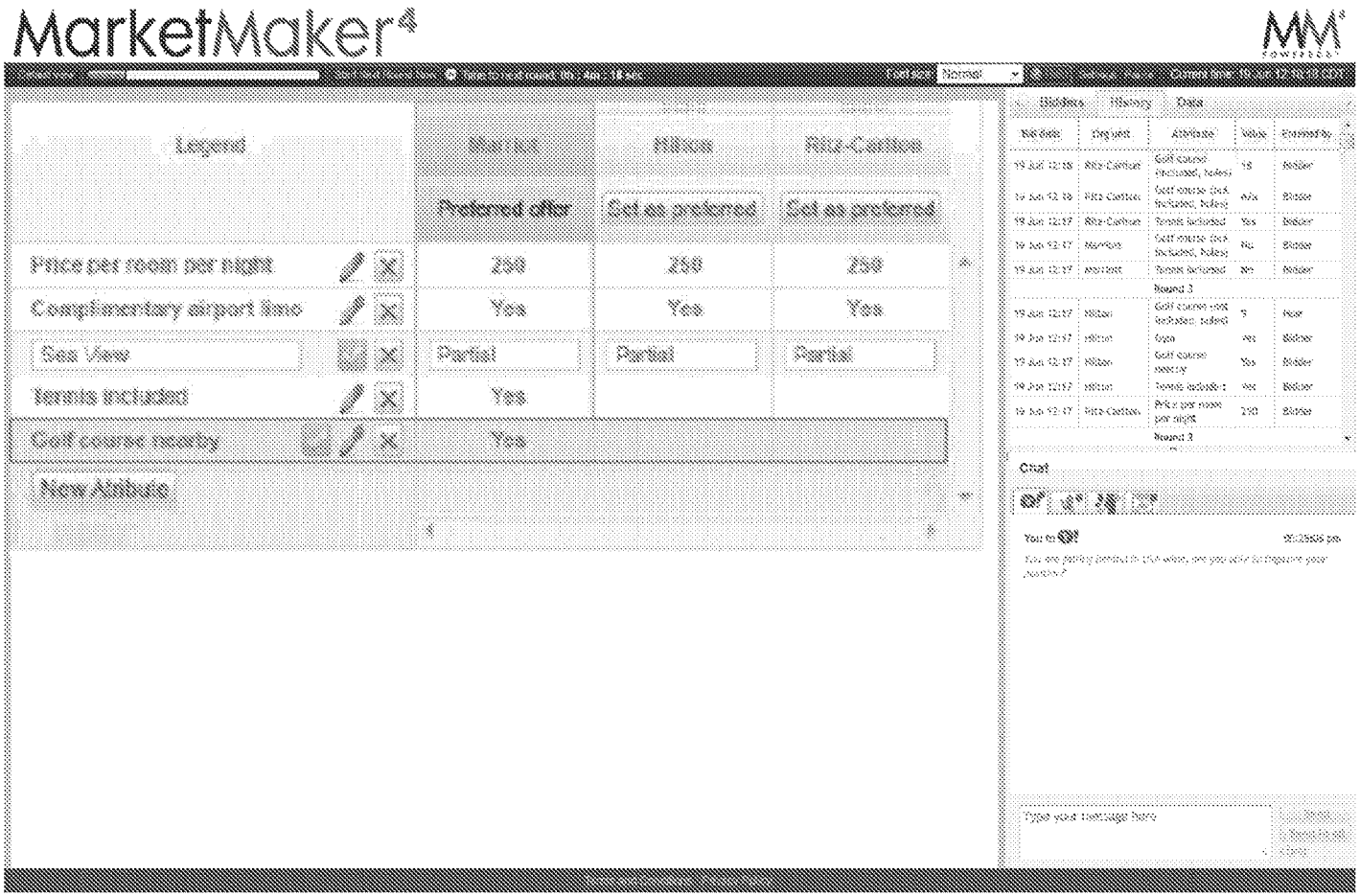
FIG. 9 shows an example for the host side in Preference Design Online Negotiations.

The attributes present could be anything that is significant in the decision of who will be win the business, and could include for example:

Price
Service Level
Features (size, colours, weight, etc)
Location
Account Management
Payment Terms
Guarantee terms
In short . . . anything that the host needs in order to be able to make the best award decision Screen Designs An example for the host side is shown in FIG. 9. In the example of FIG. 9, from the host side it is possible to add new attributes by selecting the "New Attribute" function. In FIG. 9, there are three establishment (hotel) types: Marriot, Hilton and Ritz-Carlton. The attributes which have been created are: price per room per night, complimentary airport limo, Sea View, Tennis Included and Golf course nearby. Data has been entered for the created attributes. Hence FIG. 9 is an example from the host side of a set of user(host)-creatable attributes, for which data may be entered, for a set of user(host)-definable establishments.

Figure 10:
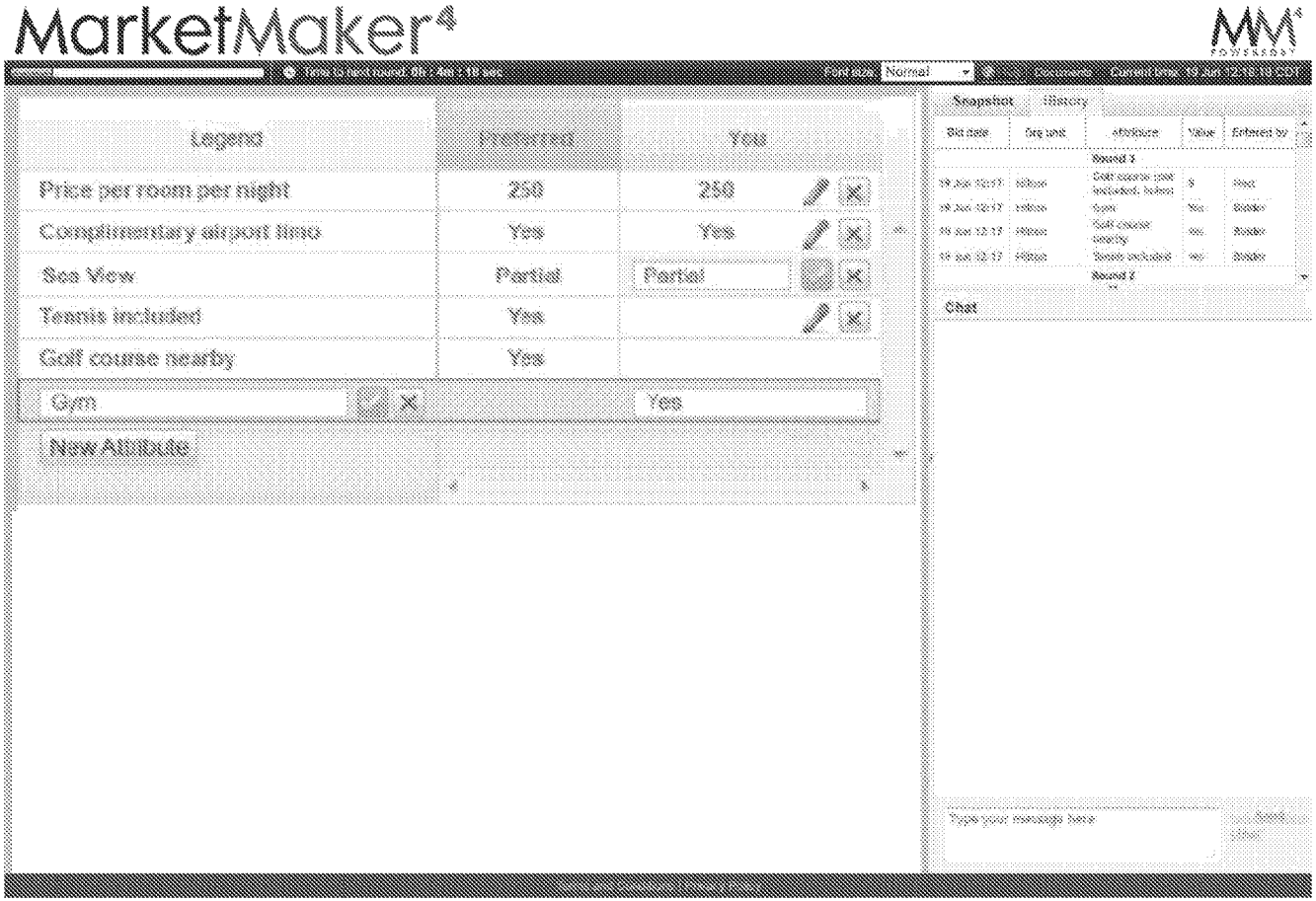
FIG. 10 shows an example for the bidder side in Preference Design Online Negotiations.

An example for the bidder side is shown in FIG. 10. In the example of FIG. 10, from the bidder side a bidder may enter bids for the attributes defined for the set of establishments shown in FIG. 9. A bid need not be a monetary value. For example, a bid may the expression of a preference, such as whether a complimentary airport limo is desired, and if Tennis is desired. A bidder may enter a new attribute by selecting the New Attribute function; a bidder may then enter a preference with respect to that new attribute.

Multi-Phased Faceted Search

The Problem

In general a faceted search requires the server to return all relevant data first, and then allows the user to select from different facets. For example when looking for flights on Opodo the user goes through the following steps:

1. Enter Search criteria, for example as shown in FIG. 11. In FIG. 11, a user has requested a search which includes the following criteria: a return flight between London Heathrow Airport and Athens Airport departing 11 Nov. 2011 and returning 18 Nov. 2011, for one adult, including low cost airlines in the search.

Figure 12:
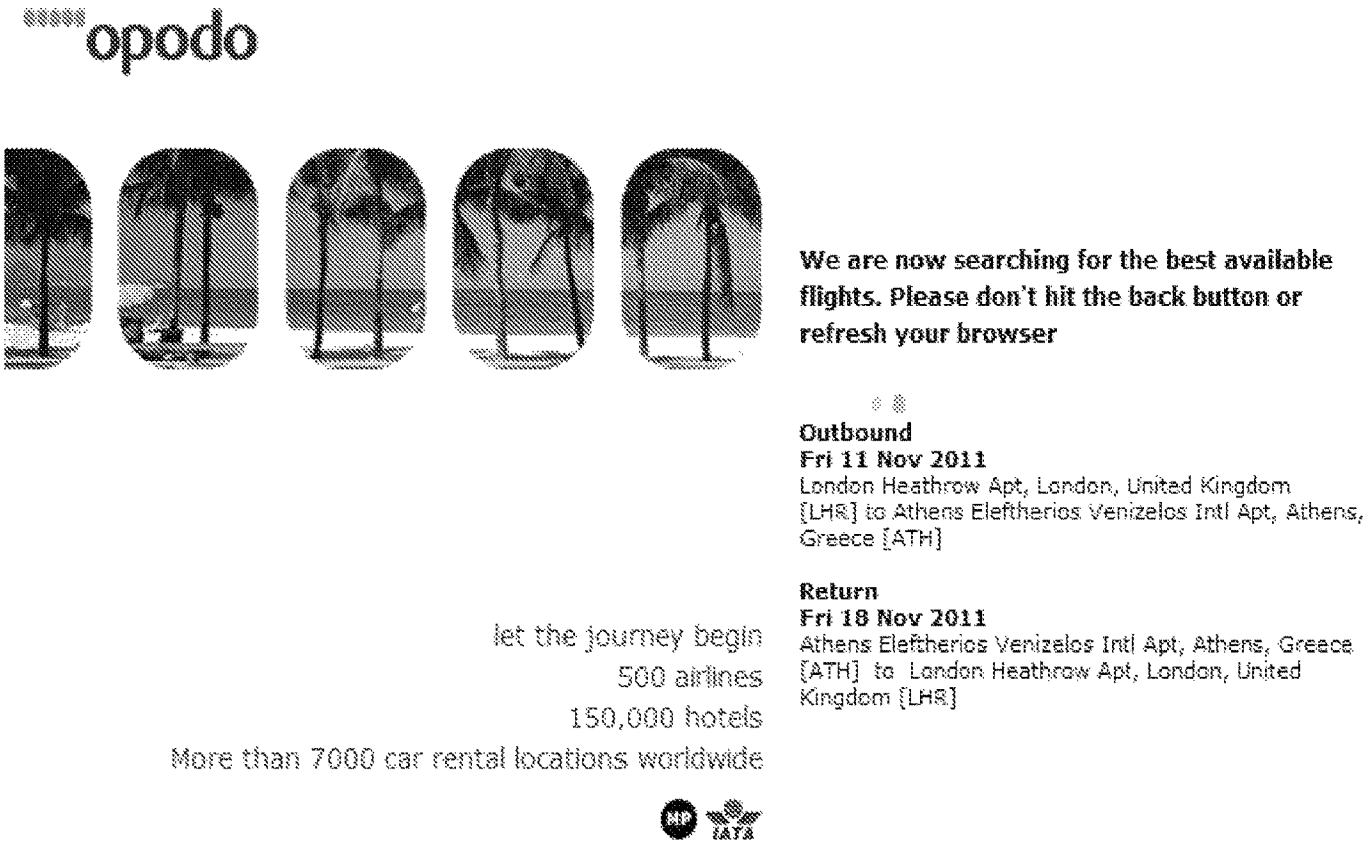
FIG. 12 shows an example of waiting for results to be found.

2. Wait for results to be found, as shown for example in FIG. 12. In FIG. 12, we see the screen displayed while the search defined in FIG. 11 is in progress.

Figure 13:
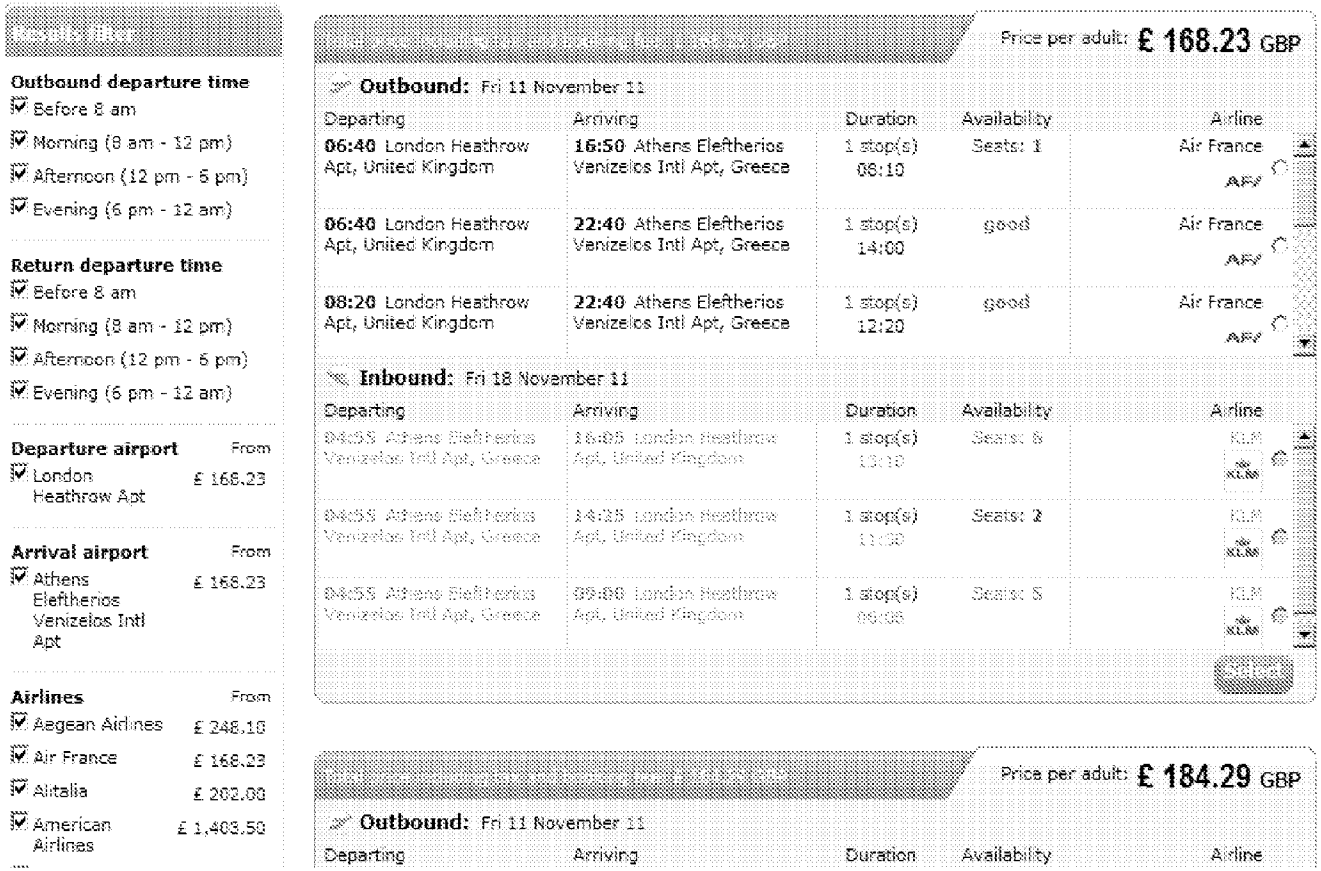
FIG. 13 shows an example of a screen in which further searching using facets is offered.

3. Search further using facets, as shown for example in FIG. 13. FIG. 13 shows search results returned in response to the search defined in FIG. 11. FIG. 13 also shows a set of facets which may be deselected so as to narrow the search. For example, if the outbound departure time "Before 8 am" is deselected, outbound flights departing before 8 am will be excluded from further searching of the search results obtained in response to the search defined in FIG. 11.

This does not work when:

a. There is a long delay to collect the initial set of data b. The data returned does not contain sufficient information to generate the facets Our Specific Problem We are working with one or several 3$^{rd}$ party providers of company information. The trivial implementation would be to query each provider, retrieve a list of companies and allow the user to search further based on the provided facets. However there are some important data points (e.g. ownership of the company, age of the company) which we can only determine by querying and indexing every single company in the result set. Some of the 3$^{rd}$ party providers have a limit to the number of allowed requests. Therefore it would be impossible to use a scenario such as that used by Opodo and generally in other faceted search implementations.

An example solution is shown in FIG. 14. In FIG. 14, events are shown by row starting at the row below the column titles, and running down the table.

In the process of FIG. 14, a user of a client web browser initiates a search request via a search box. An application server in communication with the client web browser saves a search criteria return search id to the client. The client web browser then subscribes to an update server on a channel for the search id, and the client web browser also sends a request to the application server which enqueues the search. For the enqueue search, the application server initiates a background high-level search job. A background job processor then begins an initial high-level search to return up to 100 initial company results. The background job processor notifies a push server of the initial search results. The push server pushes updates to the client. At the client web browser, the client app responds based on the new data and facet filters updated results and updates the screen. The background job processor starts downloading and indexing each company record that is considered "stale" (i.e. which has not changed in >x days). The background job processor continues searching as long as there are more high-level results to be retrieved.

On the client web browser, a user may select some high-level facet. The search is then updated on the application server. The background job processor cancels pending company searches that are no longer needed.

Any cancelled queries are re-run in a separate process to minimise the number of searches that need to be done in future similar searches.

An example solution is shown in FIG. 21. In FIG. 21, events are shown by row starting at the row below the column tides, and running down the table.

In the process of FIG. 21, a user of a client web browser initiates a search request via a search box. An application server in communication with the client web browser saves a search criteria return search id to the client. The client web browser then subscribes to an update server on a channel for the search id. At the application server this subscription triggers (1) an enqueuing of background tasks responsible for searching 3rd party APIs and (2) initiation of a search of locally-stored information (which may not be complete). A local search engine returns local search results with a custom facet structure. A background job processor begins processing enqueued tasks to call 3rd party APIs. The background job processor additionally begins re-downloading and indexing locally any individual record that is considered stale (last checked within the previous X days). Each company update routine is run in its own unique background job. On the application server, results from the background job are parsed, unified and passed to the local search engine. A push server pushes local search results to clients. The local search engine indexes the newly-provided data. The push server pushes newly indexed data from remote sources to clients. The background job processor continues searching as long as there are more results to be retrieved or the search is cancelled by the user. The client web browser reacts to push of new data and updates search results and facets. At the client web browser, the user modifies one or more facets and/or search criteria. The application server updates conditions for query and facets, and restarts the local and remote search. Regarding the background job processor, pending company searches that are no longer required are cancelled.

Any cancelled queries are re-run in a separate process to minimise the number of searches that need to be done in future similar searches.

Example Screens

Figure 15:
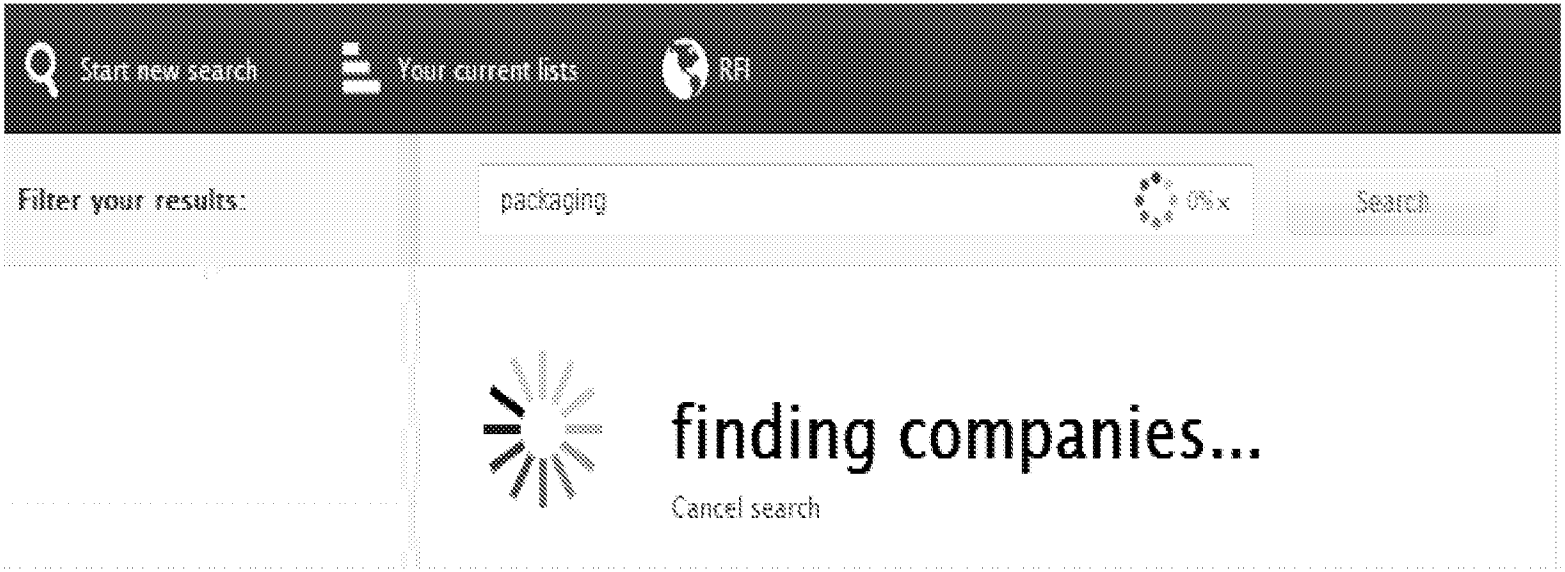
FIG. 15 shows an example of an initial search in a multi-phased faceted search.

1. Initial search started is shown for example in FIG. 15. FIG. 15 shows an example screen displayed in response to a user initiating a search using the string "packaging".

Figure 16:
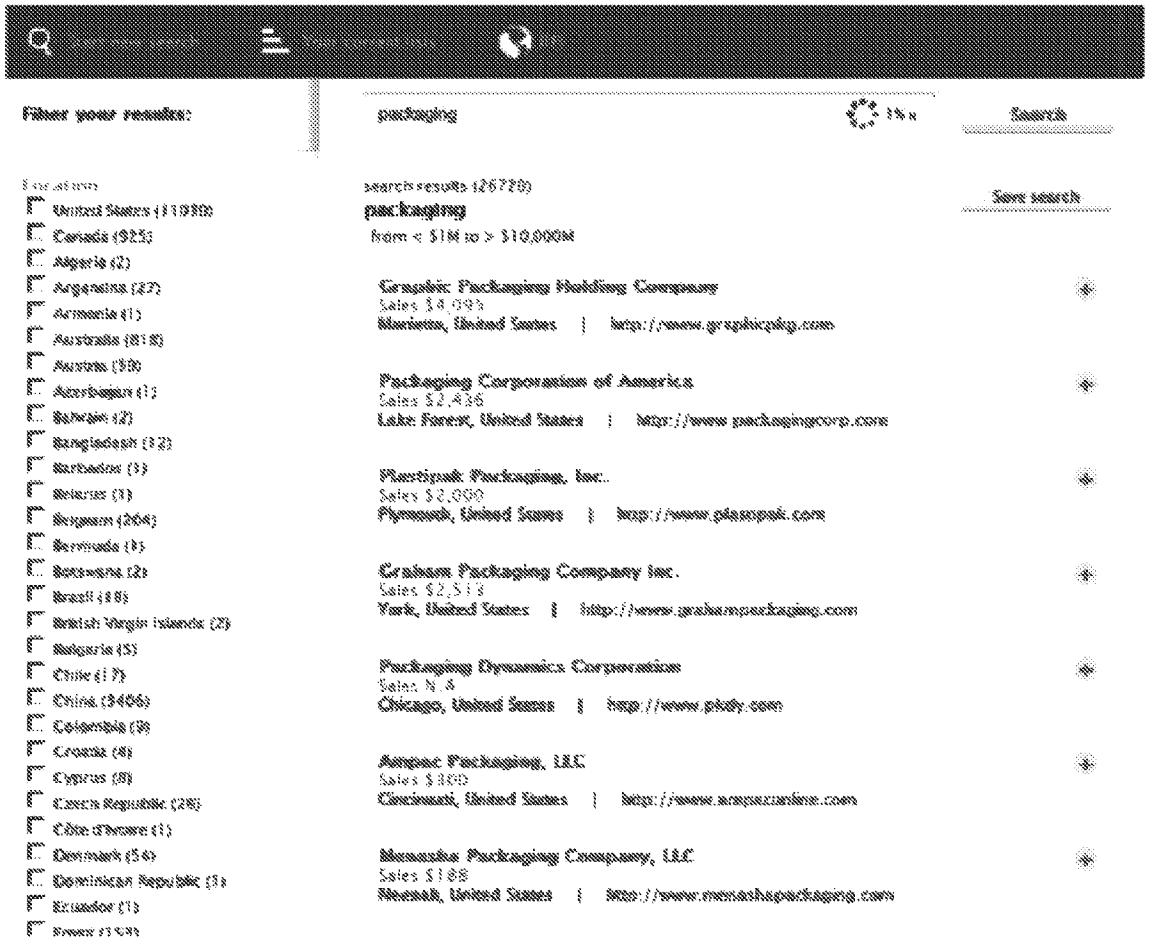
FIG. 16 shows an example of search results in an initial search in a multi-phased faceted search.

2. In this example, Phase 1 search results return 26,720 companies and high-level facets are made available immediately, as shown for example in FIG. 16. FIG. 16 shows example search results for companies with business activities relating to the search string "packaging". For each firm displayed, data regarding the company name, its sales revenue, its geographic location, and its website address, are displayed. Information about the number of search results by country is also displayed. It is possible to filter the search results by country: this is a high-level facet.

Figure 17:
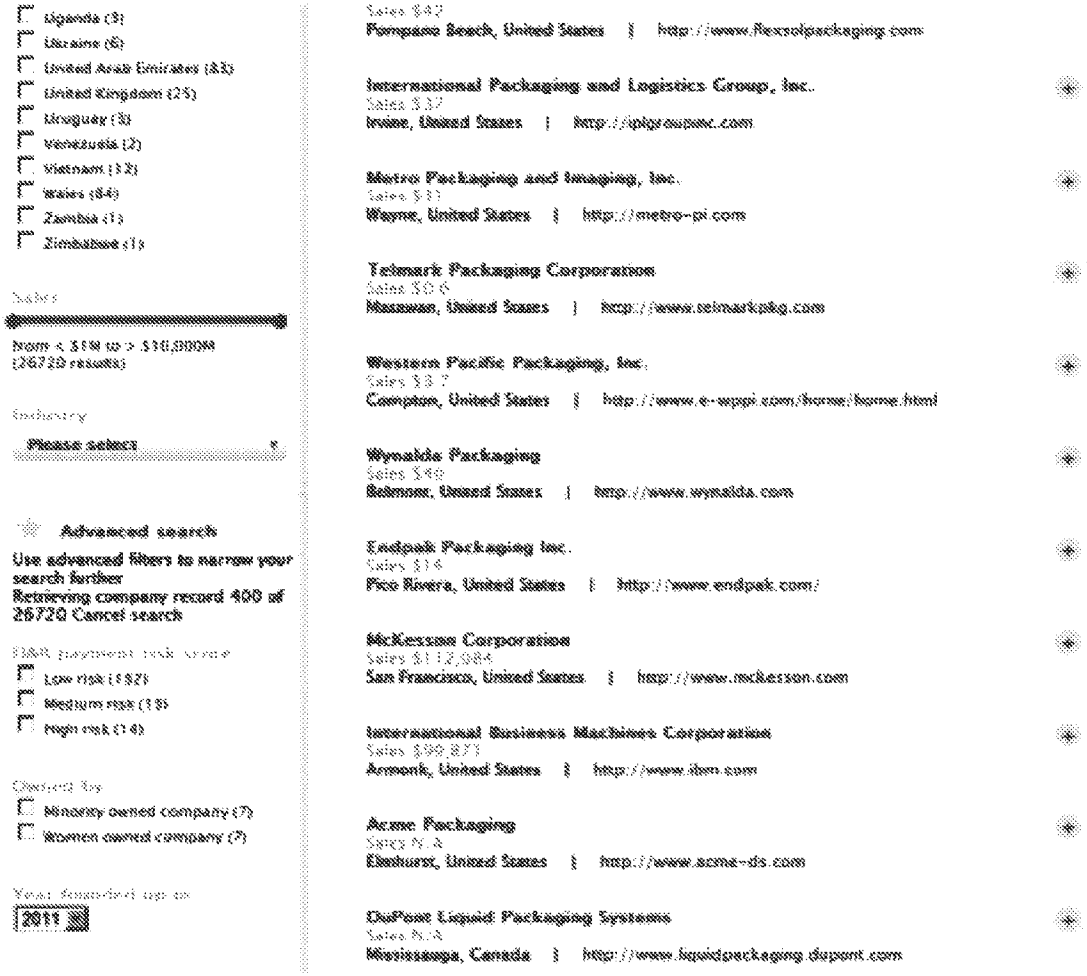
FIG. 17 shows an example of search results in an initial search in a multi-phased faceted search.

3. Right now the system begins downloading and indexing all of those 26,720 companies. The phase 2 facets indicate how many of the 26,720 companies have already been downloaded and indexed (in the FIG. 17 example there are 400 out of 26,720). An example is shown in FIG. 17.

Figure 18:
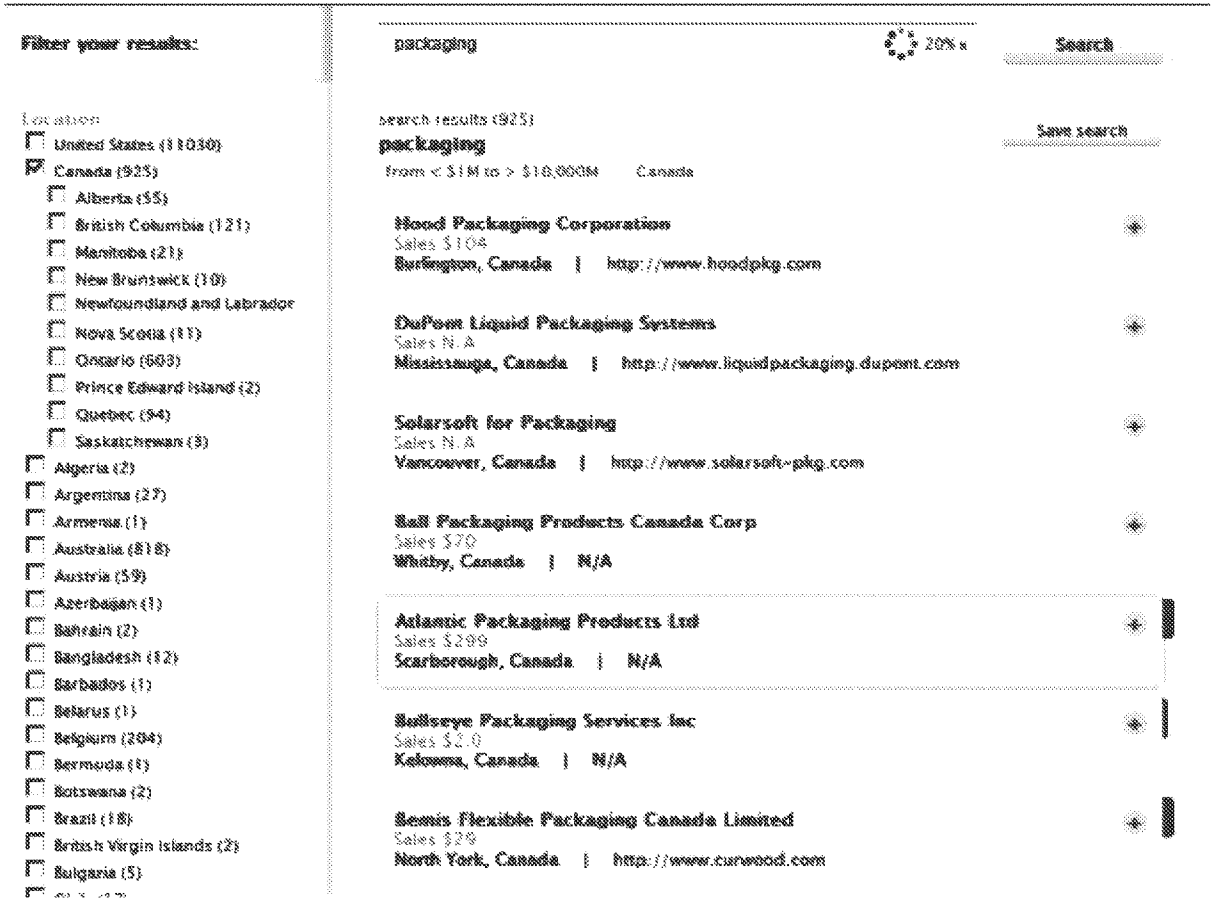
FIG. 18 shows an example of narrowing down search results in an initial search in a multi-phased faceted search.

4. If the user now narrows down the search by selecting for example Canada, all but 925 of the searches are cancelled. An example is shown in FIG. 18. In FIG. 18, only the country Canada has been selected of the available countries. The number of search results is 925. For each firm displayed, data regarding the company name, its sales revenue, its geographic location, and its website address, are displayed. It is possible to filter the search results by country region. In Canada, the country regions are provinces, hence the results may be further filtered with respect to provinces of Canada eg. Alberta, British Columbia, Manitoba, etc. Filtering by country region is a lower level facet than the high-level facet of country shown in FIGS. 16 and 17. Hence FIG. 18 shows that after filtering with respect to a high-level facet is performed, the option to filter with respect to a lower level facet may be offered to a user. In addition, FIG. 18 shows that further high level facets are selectable to broaden the search results (eg. Argentina results may be added to Canada results by selecting the Argentina tick box), and low level facets are additionally selectable to further narrow the results (eg. if the tick box for the Canadian province Alberta is selected, all results from Canadian provinces other than Alberta will be removed from the search results).

Figure 19:
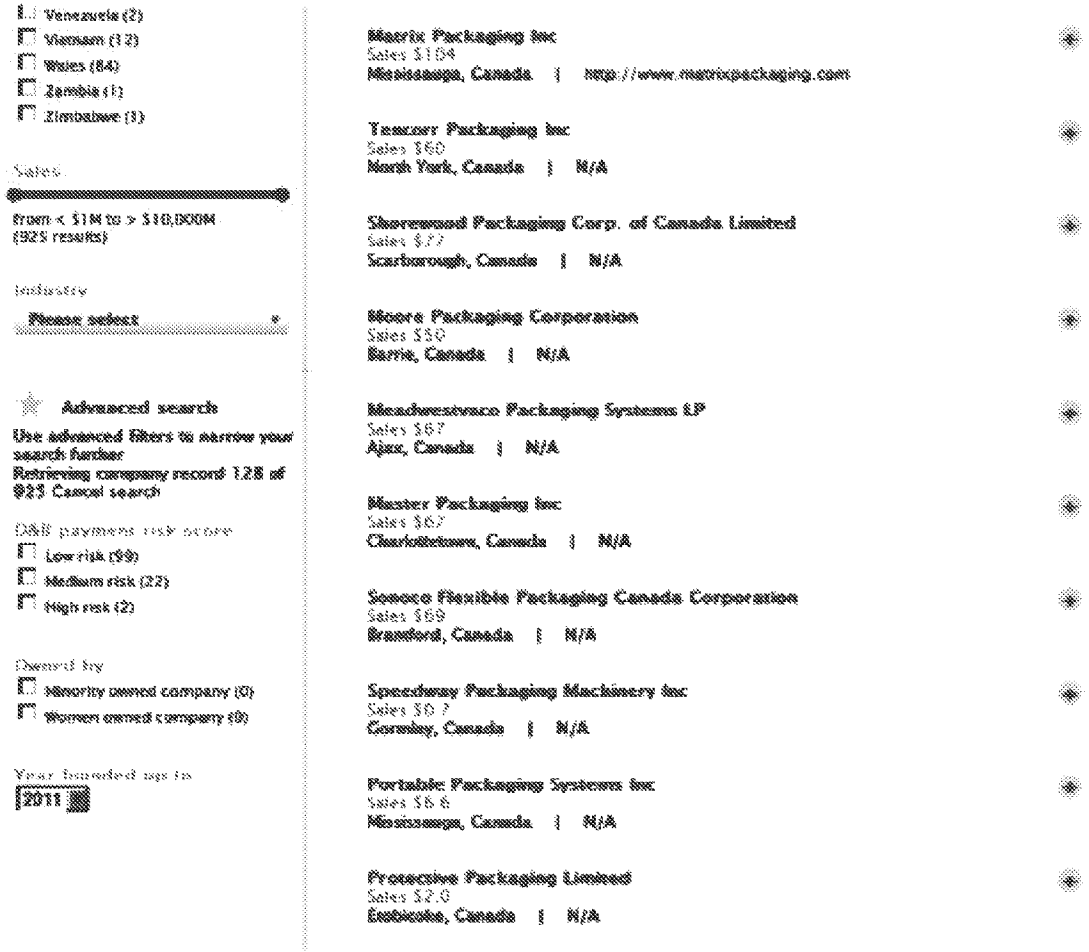
FIG. 19 shows an example in which the advanced search facets now show that the app is downloading and indexing 128 of 925 company records so far.
Figure 20:
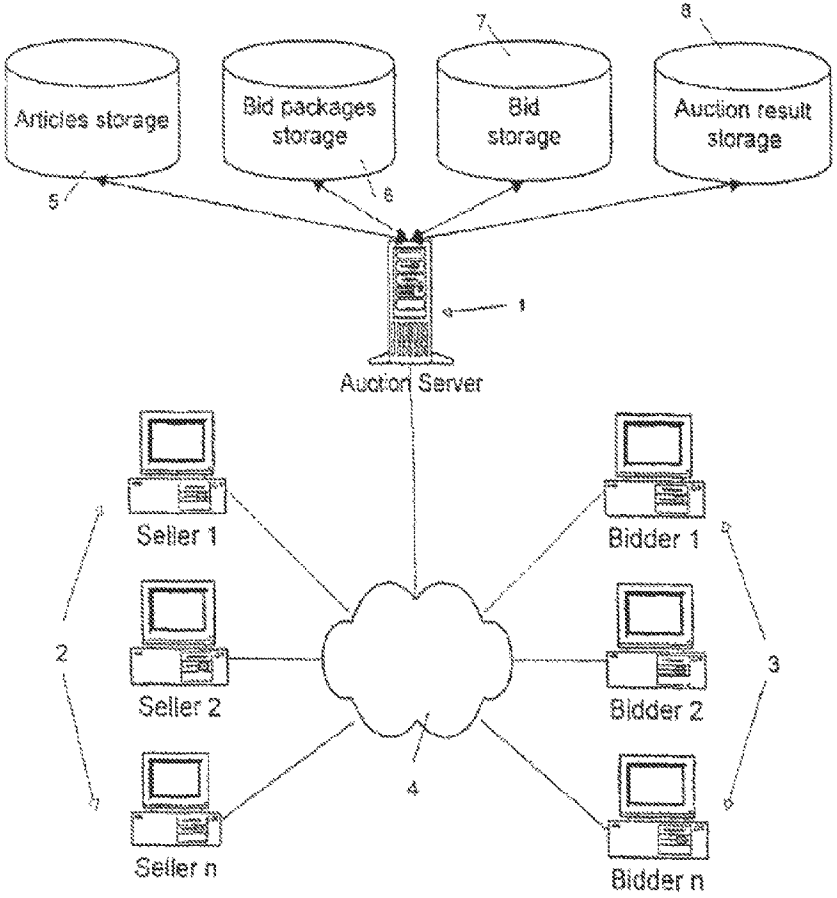
FIGURE 20 PRIOR ART
FIG. 20 shows a block diagram relating to conducting an auction in a computer environment according to EP1012764B1.
Figure 22:
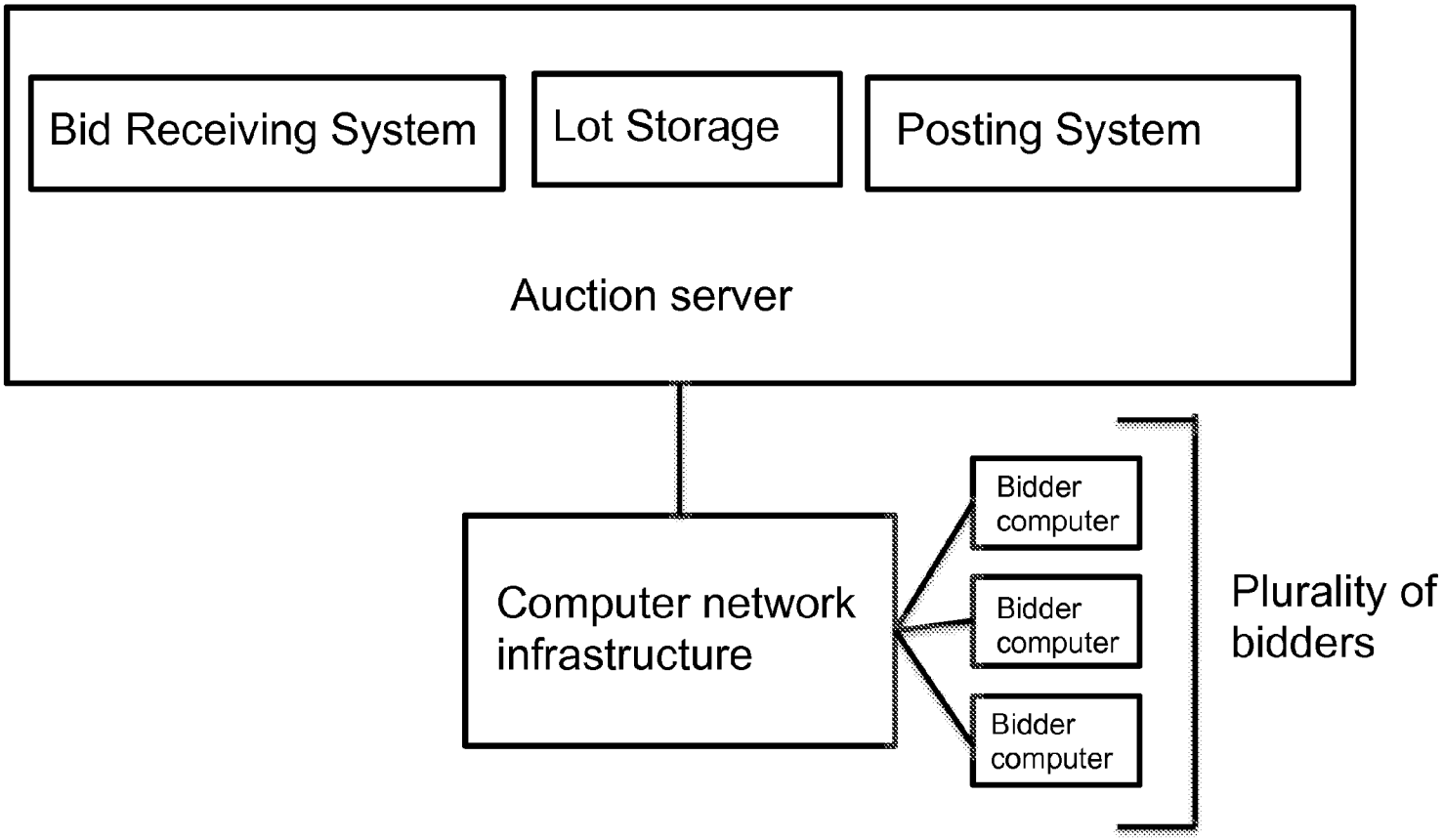
FIG. 22 shows an example of a computer system for conducting auctions over a computer network, the computer system including an auction server hosting a bid receiving system, a posting system, and a lot storage, wherein the posting system is operable to post on the computer network information describing each lot of a plurality of lots that are available for bidding by a plurality of bidders.

5. And the advanced search facets now show that the app is downloading and indexing 128 of 925 company records so far: see the example of FIG. 19. The user can now narrow his search using these facets but as new companies are downloaded and indexed they will be appended to his search results, depending on the facets chosen.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred example(s) of the invention, it will be apparent to those of ordinary skill in the art that numerous modifications can be made without departing from the principles and concepts of the invention as set forth herein.

Concepts

There are multiple concepts, described as concepts 'A-D, in this disclosure. The following may be helpful in defining these concepts. Elements of concepts A to D may be combined.

A. Method and Computer System for Conducting Auctions Over a Computer Network

Computer-implemented method of conducting auctions over a computer network, the method comprising the steps of:

(i) defining an n-dimensional matrix, in which n is at least 2, wherein the matrix comprises a plurality of lots, each lot including at least one item, (ii) posting the matrix on the computer network, the matrix including information describing each lot of the plurality of lots that are available for bidding by a plurality of bidders, and (iii) receiving a bid relating to at least a portion of a lot of the plurality of lots.

Further aspects may include

The n-dimensional matrix is defined on a posting system.

posting the matrix on the computer network includes the posting system making the matrix available for display on screens of computers in the computer network.

receiving a bid includes receiving a bid at a bid receiving system.

n=2.

n=3.

n=4.

n≥3.

n≥4.

receiving a bid relating to at least a portion of a lot of the plurality of lots includes receiving a plurality of bids relating to a plurality of lots in the matrix.

n=2, and the two dimensions relate to product categories and to groupings.

Groupings are territorial groups, service levels or product types.

adding multiple attributes to an element of the matrix using a posting system.

Attrributes include one or more of images, colour, weight, document attachments, size, unit of measure, description, reference number.

n≥3, and the matrix comprises sub-matrices of dimension m<n, and the results of related sub-matrices of dimension m<n are aggregatable upwards through an arbitrary number of levels, each structured in a matrix format.

m=2.

n≥3, and the cells in a top level of the matrix presented on a computer screen are expandable to present a sub-matrix of dimension p<n.

p=2.

n≥4, and the cells in a top level of the matrix presented on a computer screen are expandable to present a sub-matrix of dimension q<(n−1).

q=2.

a 3-level nested matrix setup is provided on a computer screen, and each cell in this setup is expandable to represent the results from one matrix negotiation.

the results from each matrix negotiation functions as an independent negotiation.

bids can be received for different levels of the matrix.

bids can be received across the whole negotiation.

bids can be received across all groups for an item.

bids can be received across all groups within a group type for an item.

bids can be received across all items for a group.

bids can be received within a cell.

A bid can be defined by a formula entered by a user.

Bid elements do not have to be numeric.

Bid elements can also be text fields such as a part number or a comment from the bidder.

Bidders can indicate which items they do not intend to bid on.

All bidders must enter reserve bids for each item that they intend to bid on.

Reserves can be modified during the live negotiation.

identifying the cell on which the bidder has the greatest margin, and therefore the cell in which they can make the biggest change while retaining the maximum margin.

Identifying the lot on which the bidder has the greatest margin.

Identifying the lot that, if the bidder were leading on it, would add the greatest amount of net margin to the bidder's benefit.

Auto-bidding on behalf of the bidder.

Auto-bidding wherein an auto-bidding system will continue placing leading bids during the live auction up until the bidder's limit is reached.

Auto-bidding wherein an auto-bidding system will make one single attempt to lead in any items where the bidder can achieve first place without going beyond his reserves.

Auto-bidding wherein an auto-bidding system will continue to bid as aggressively as possible to gain first place, or even to simply offer as good a bid as possible without necessarily gaining the lead.

identifying the lot which, if the bidder were leading on it, would add the largest amount of overall value to their total set of leading lots.

Providing cell-level and lot-level leading competitor information.

Providing colour-coding on the bidder's relative position.

a colour coding is applied to indicate any cells where the bidder has gone beyond her reserve.

negotiation bidders are only able to see competitor information if they are within x % of the leading bid, where x is configurable by the host.

downloading all the relevant data for the negotiation for a bidder to consider and update their bids offline and then re-upload.

The data is downloadable into one spreadsheet that can then be re-uploaded.

Different rules are available to define the winner of an auction.

Available rules include one or more of: awarding each lot to the best bidder, awarding each individual item to the best bidder, awarding as much as possible to incumbents, awarding overall to the fewest possible bidders, and awarding x % to minority bidders.

The matrix design negotiation allows a host to compare different allocation plans live during the event.

Matrix design negotiation pushes near real-time updates with a fallback to regular timed page refreshes where real-time updates are not possible.

The Matrix Design Negotiation Server (MDNS) pushes out updates to notify clients that they should request an update.

cells are expandable in one dimension to list multiple types of information based on the bids received.

cells are expandable in one dimension to list multiple types of price information based on the bids received.

cells are expandable in one dimension to list categories which correspond to a given cell.

cells are expandable in one dimension to list categories which correspond to a given cell, and other cells are expandable in another dimension to list multiple types of information based on the bids received.

There is further provided a computer system for conducting auctions over a computer network, comprising:

a posting system operable to post on the computer network information describing each lot of a plurality of lots that are available for bidding by a plurality of bidders, each lot including at least one item;

a bid receiving system for receiving a bid related to at least a portion of a lot of the plurality of lots, characterized in that the posting system is operable to define an n-dimensional matrix, where n is at least 2, wherein the matrix comprises the plurality of lots, and wherein the posting system is operable to post the matrix on the computer network.

Further aspects may include posting the matrix on the computer network includes the posting system making the matrix available for display on screens of computers in the computer network.

n=2.

n=3.

n=4.

n≥3.

n≥4.

The bid receiving system is operable to receive a plurality of bids relating to a plurality of lots in the matrix.

n=2, and the two dimensions relate to product categories and to groupings.

Groupings are territorial groups, service levels or product types.

The posting system is operable to add multiple attributes to an element of the matrix.

Attrributes include one or more of images, colour, weight, document attachments, size, unit of measure, description, reference number.

n≥3, and the matrix comprises sub-matrices of dimension m<n, and the results of related sub-matrices of dimension m<n are aggregatable upwards through an arbitrary number of levels, each structured in a matrix format.

m=2.

n≥3, and the cells in a top level of the matrix presented on a computer screen are expandable to present a sub-matrix of dimension p<n.

p=2.

n≥4, and the cells in a top level of the matrix presented on a computer screen are expandable to present a sub-matrix of dimension q<(n−1).

q=2.

a 3-level nested matrix setup is provided on a computer screen, and each cell in this setup is expandable to represent the results from one matrix negotiation.

the results from each matrix negotiation functions as an independent negotiation.

bids can be received for different levels of the matrix.

bids can be received across the whole negotiation.

bids can be received across all groups for an item.

bids can be received across all groups within a group type for an item.

bids can be received across all items for a group.

bids can be received within a cell.

A bid can be defined by a formula entered by a user.

Bid elements do not have to be numeric.

Bid elements can also be text fields such as a part number or a comment from the bidder.

Bidders can indicate which items they do not intend to bid on.

All bidders must enter reserve bids for each item that they intend to bid on.

Reserves can be modified during the live negotiation.

identifying the cell on which the bidder has the greatest margin, and therefore the cell in which they can make the biggest change while retaining the maximum margin.

Identifying the lot on which the bidder has the greatest margin.

Identifying the lot that, if the bidder were leading on it, would add the greatest amount of net margin to the bidder's benefit.

Auto-bidding on behalf of the bidder.

Auto-bidding wherein an auto-bidding system will continue placing leading bids during the live auction up until the bidder's limit is reached.

Auto-bidding wherein an auto-bidding system will make one single attempt to lead in any items where the bidder can achieve first place without going beyond his reserves.

Auto-bidding wherein an auto-bidding system will continue to bid as aggressively as possible to gain first place, or even to simply offer as good a bid as possible without necessarily gaining the lead.

identifying the lot which, if the bidder were leading on it, would add the largest amount of overall value to their total set of leading lots.

Providing cell-level and lot-level leading competitor information.

Providing colour-coding on the bidder's relative position.

a colour coding is applied to indicate any cells where the bidder has gone beyond her reserve.

negotiation bidders are only able to see competitor information if they are within x % of the leading bid, where x is configurable by the host.

downloading all the relevant data for the negotiation for a bidder to consider and update their bids offline and then re-upload.

The data is downloadable into one spreadsheet that can then be re-uploaded.

Different rules are available to define the winner of an auction.

Available rules include one or more of: awarding each lot to the best bidder, awarding each individual item to the best bidder, awarding as much as possible to incumbents, awarding overall to the fewest possible bidders, and awarding x % to minority bidders.

The matrix design negotiation allows a host to compare different allocation plans live during the event.

Matrix design negotiation pushes near real-time updates with a fallback to regular timed page refreshes where real-time updates are not possible.

The Matrix Design Negotiation Server (MDNS) pushes out updates to notify clients that they should request an update.

cells are expandable in one dimension to list multiple types of information based on the bids received.

cells are expandable in one dimension to list multiple types of price information based on the bids received.

cells are expandable in one dimension to list categories which correspond to a given cell.

cells are expandable in one dimension to list categories which correspond to a given cell, and other cells are expandable in another dimension to list multiple types of information based on the bids received.

Computer system includes an auction server hosting the bid receiving system, the posting system, and a lot storage.

The computer network is the internet.

There is further provided a computer-readable medium containing instructions for conducting auctions over a computer network through steps comprising:

(i) defining an n-dimensional matrix, in which n is at least 2, wherein the matrix comprises a plurality of lots, each lot including at least one item, (ii) posting the matrix on the computer network, the matrix including information describing each lot of the plurality of lots that are available for bidding by a plurality of bidders, and (iii) receiving a bid relating to at least a portion of a lot of the plurality of lots.

Further aspects may include those defined for the method of this concept.

B. Method and Computer System for Conducting Auctions and Preference Design Over a Computer Network Computer-implemented method of conducting auctions and preference design over a computer network, the method comprising the steps of:

(i) defining a plurality of lots, each lot including at least one item, (ii) posting the plurality of lots on the computer network, the plurality of lots including information describing each lot of the plurality of lots that are available for bidding by a plurality of bidders, (iii) receiving a suggestion from a bidder of a new attribute to characterize a lot, (iv) including the attribute to characterize the lot, and (v) receiving a bid relating to at least a portion of a lot of the plurality of lots.

Further aspects may include:

defining an n-dimensional matrix, in which n is at least 2, wherein the matrix comprises the plurality of lots, each lot including at least one item.

The n-dimensional matrix is defined on a posting system.

posting the matrix on the computer network includes the posting system making the matrix available for display on screens of computers in the computer network.

receiving a bid includes receiving a bid at a bid receiving system.

posting the plurality of lots on the computer network includes a posting system making the plurality of lots available for display on screens of computers in the computer network.

A Host can accept or reject suggested attributes.

A Host can edit suggested attributes.

A Host can edit bidder responses on behalf of those bidders.

changes are logged in an audit trail.

Attributes may include one or more of Price, Service Level, Features (size, colours, weight, etc), Location, Account Management, Payment Terms, Guarantee terms, or anything that the host needs in order to be able to make the best award decision.

Bidder provides suggestion of a new attribute by selecting a "New Attribute" function on a user interface screen.

a bidder may then enter a preference with respect to that new attribute, on a user interface screen.

host can add a new attribute by selecting a "New Attribute" function, on a user interface screen.

Any aspects of concept A.

There is further provided a computer system for conducting auctions over a computer network, comprising:

a posting system operable to post on the computer network information describing each lot of a plurality of lots that are available for bidding by a plurality of bidders, each lot including at least one item;

a bid receiving system for receiving a bid related to at least a portion of a lot of the plurality of lots, wherein the computer system is operable to receive a suggestion from a bidder of a new attribute to characterize a lot, and the computer system is operable to include the attribute to characterize the lot.

Further aspects may include:

the posting system is operable to define an n-dimensional matrix, where n is at least 2, wherein the matrix comprises the plurality of lots, and wherein the posting system is operable to post the matrix on the computer network.

posting the matrix on the computer network includes the posting system making the matrix available for display on screens of computers in the computer network.

Computer system includes an auction server hosting the bid receiving system, the posting system, and a lot storage.

defining an n-dimensional matrix, in which n is at least 2, wherein the matrix comprises the plurality of lots, each lot including at least one item.

The n-dimensional matrix is defined on the posting system.

posting the matrix on the computer network includes the posting system making the matrix available for display on screens of computers in the computer network.

posting the plurality of lots on the computer network includes the posting system making the plurality of lots available for display on screens of computers in the computer network.

A Host can accept or reject suggested attributes.

A Host can edit suggested attributes.

A Host can edit bidder responses on behalf of those bidders.

changes are logged in an audit trail.

Attributes may include one or more of Price, Service Level, Features (size, colours, weight, etc), Location, Account Management, Payment Terms, Guarantee terms, or anything that the host needs in order to be able to make the best award decision.

Bidder provides suggestion of a new attribute by selecting a "New Attribute" function on a user interface screen.

a bidder may then enter a preference with respect to that new attribute, on a user interface screen.

host can add a new attribute by selecting a "New Attribute" function, on a user interface screen.

The computer network is the internet.

Any aspects of concept A.

There is further provided a computer-readable medium containing instructions for conducting auctions over a computer network through steps comprising:

(i) defining a plurality of lots, each lot including at least one item, (ii) posting the plurality of lots on the computer network, the plurality of lots including information describing each lot of the plurality of lots that are available for bidding by a plurality of bidders, (iii) receiving a suggestion from a bidder of a new attribute to characterize a lot, (iv) including the attribute to characterize the lot, and (v) receiving a bid relating to at least a portion of a lot of the plurality of lots.

Further aspects may include those defined for the method of this concept.

C. Method of Performing a Multi-Phased Faceted Search

Computer-implemented method of performing a multi-phased faceted search, comprising the steps of:

(i) Initiating a search request by submitting a search request from a client to an application server;

(ii) triggering (1) an enqueuing of background tasks responsible for searching 3rd party APIs at the application server;

(iii) Triggering (2) initiation of a search of locally-stored information at the application server;

(iv) returning local search results with a custom facet structure from a local search engine;

(v) beginning processing enqueued tasks to call 3rd party APIs on a background job processor;

(vi) parsing, unifying and passing to the local search engine on the application server results from the background job;

(vii) pushing local search results to the client;

(viii) indexing the newly-provided data on the local search engine;

(ix) pushing newly-indexed data from remote sources to the client, and (x) the application server updating conditions for query and facets, and restarting the local and remote search, in response to a user modifying one or more facets and/or search criteria.

Further aspects may include:

Saving a search criteria return search id to the client from the application server.

The client subscribing to an update server on a channel for the search id.

Beginning re-downloading and indexing locally any individual record that has not changed within a defined number of previous days.

The client is a client web browser.

user of a client web browser initiates a search request via a search box.

A local search engine returns local search results with a custom facet structure.

Each company update routine is run in its own unique background job.

A push server pushes local search results to clients.

The push server pushes newly indexed data from remote sources to clients.

The background job processor continues searching as long as there are more results to be retrieved or the search is cancelled by the user.

The client web browser reacts to push of new data and updates search results and facets.

At the client web browser, the user modifies one or more facets and/or search criteria.

Regarding the background job processor, pending company searches that are no longer required are cancelled.

Any cancelled queries are re-run in a separate process to minimise the number of searches that need to be done in future similar searches.

There is further provided a computer system for performing a multi-phased faceted search over a computer network, comprising:

a client, an application server, a local search engine, a push server and a background job processor, wherein (i) the application server is operable to initiate a search request in response to a search request from the client to the application server;

(ii) the application server is operable to trigger (1) an enqueuing of background tasks responsible for searching 3rd party APIs;

(iii) the application server is operable to trigger (2) initiation of a search of locally-stored information at the application server;

(iv) the application server is operable to return local search results with a custom facet structure from a local search engine;

(v) the application server is operable to begin processing enqueued tasks to call 3rd party APIs on the background job processor;

(vi) the application server is operable to parse, unify and pass to the local search engine on the application server results from the background job;

(vii) the push server is operable to push local search results to the client;

(viii) the application server is operable to index the newly-provided data on the local search engine;

(ix) the push server is operable to push newly-indexed data from remote sources to the client, and (x) the application server is operable to update conditions for query and facets, and to restart the local and remote search, in response to a user modifying one or more facets and/or search criteria.

Other features may include any of those of the method of this concept.

D. Method of Performing a Multi-Phased Faceted Search

Computer-implemented method of performing a multi-phased faceted search, comprising the steps of:

(i) Initiating a search request by submitting a search request from a client to an application server;

(ii) enqueuing the search at the application server, wherein the application server initiates a background high-level search job on a background job processor;

(iii) the background job processor notifying a push server of the initial search results;

(iv) the push server pushing updates to the client;

(v) the client responding based on the new data and facet filters updated results and updates a screen;

(vi) the background job processor starts downloading and indexing each record that has not changed in a predefined number of days;

(vii) the background job processor continuing searching as long as there are more high-level results to be retrieved;

(viii) updating the search on the application server in response to a user selection of a facet on the client.

Further aspects may include:

Client is a client web browser.

Saving a search criteria return search id to the client from the application server.

The client subscribing to an update server on a channel for the search id.

the client web browser also sends a request to the application server which enqueues the search.

The background job processor begins an initial high-level search to return up to a predetermined number of initial results.

The background job processor cancels pending company searches that are no longer needed.

Any cancelled queries are re-run in a separate process to minimise the number of searches that need to be done in future similar searches.

Records are company records.

There is further provided a computer system for performing a multi-phased faceted search over a computer network, comprising:

a client, an application server, a local search engine, a push server and a background job processor, wherein (i) the client initiates a search request by submitting a search request from the client to the application server;

(ii) the application server enqueues the search at the application server, wherein the application server initiates a background high-level search job on the background job processor;

(iii) the background job processor notifies the push server of the initial search results;

(iv) the push server pushes updates to the client;

(v) the client responds based on the new data and facet filters updated results and updates a screen;

(vi) the background job processor starts downloading and indexing each record that has not changed in a predefined number of days;

(vii) the background job processor continues searching as long as there are more high-level results to be retrieved;

(viii) the search is updated on the application server in response to a user selection of a facet on the client.

Other features may include any of those of the method of this concept.

The invention claimed is:

1. A computer system for conducting auctions over a computer network, comprising:

a posting system configured to post a matrix over the computer network, the matrix comprising a first plurality of cells, the matrix describing at least one lot of a plurality of lots that is available for bidding by a plurality of bidders, each lot in the plurality of lots comprising at least a cell and including at least one item presented in the cell for bidding, wherein the cell is expandable to present a first sub-matrix, and wherein the first sub-matrix comprises a second plurality of cells and a subset of cells in the first sub-matrix is expandable to present a second sub-matrix, and wherein the second sub-matrix comprises a third plurality of cells and a subset of cells in the second sub-matrix represents bids from a bidding process;

a bid receiving system configured to receive a bid from the plurality of bidders, through the second sub-matrix, relating to the at least one item; and a search system configured to perform a multi-phased faceted search.

2. The computer system of claim 1, wherein the posting system is configured to post the matrix on the computer network to make the matrix available for display on screens of computers in the computer network.

3. The computer system of claim 1, wherein the bid receiving system is configured to receive a plurality of bids relating to the plurality of lots in the matrix.

4. The computer system of claim 1, wherein the posting system is configured to add attributes to the first sub-matrix.

5. The computer system of claim 4, wherein the attributes relate to product categories and to groupings.

6. The computer system of claim 1, wherein the bidding system is configured to receive bids from the second sub-matrix.

7. The computer system of claim 1, wherein the bidding system is configured to download data for a bidder and update a particular bid offline and re-upload the particular bid.

8. The computer system of claim 1, further comprising an auction server hosting the bid receiving system, the posting system, and a lot storage.

9. A computer-implemented method of conducting auctions over a computer network, the method comprising:

defining a matrix, the matrix comprising a first plurality of cells, the matrix describing at least one lot of a plurality of lots that is available for bidding by a plurality of bidders, each lot in the plurality of lots comprising at least a cell and including at least one item presented in the cell for bidding, wherein the cell is expandable to present a first sub-matrix, and wherein the first sub-matrix comprises a second plurality of cells and a subset of cells in the first sub-matrix is expandable to present a second sub-matrix, and wherein the second sub-matrix comprises a third plurality of cells and a subset of cells in the second sub-matrix represents bids from a bidding process;

posting the matrix over the computer network, the matrix available for bidding by a plurality of bidders;

receiving a bid from the plurality of bidders, through the second sub-matrix, relating to the at least one item; and performing a multi-phased faceted search.

10. The method of claim 9, wherein defining the matrix is performed on a posting system.

11. The method of claim 9, wherein posting the matrix over the computer network includes making the matrix available for display on screens of computers in the computer network.

12. The method of claim 9, wherein receiving the bid includes receiving a bid at a bid receiving system.

13. The method of claim 9, wherein receiving the bid includes receiving a plurality of bids relating to the plurality of lots in the matrix.

14. The method of claim 9, further comprising adding attributes to the first sub-matrix.

15. The method of claim 9, further comprising receiving bids from the second sub-matrix.

16. A non-transitory computer-readable medium containing instructions for conducting auctions over a computer network that, when executed by at least one processor of a computing system, cause the computing system to perform a method comprising:

defining a matrix, the matrix comprising a first plurality of cells, the matrix describing at least one lot of a plurality of lots that is available for bidding by a plurality of bidders, each lot in the plurality of lots comprising at least a cell and including at least one item presented in the cell for bidding, wherein the cell is expandable to present a first sub-matrix, and wherein the first sub-matrix comprises a second plurality of cells and a subset of cells in the first sub-matrix is expandable to present a second sub-matrix, and wherein the second sub-matrix comprises a third plurality of cells and a subset of cells in the second sub-matrix represents bids from a bidding process;

posting the matrix over the computer network, the matrix available for bidding by a plurality of bidders;

receiving a bid from the plurality of bidders, through the second sub-matrix, relating to the at least one item; and performing a multi-phased faceted search.

17. The computer system of claim 1, wherein performing a multi-phased faceted search includes:

initiating a search request in response to a search request from a client to an application server;

triggering an enqueuing of background tasks responsible for searching third party APIs;

triggering initiation of a search of locally-stored information at the application server;

returning local search results with a custom facet structure from a local search engine;

beginning processing enqueued tasks to call the third party APIs on a background job processor;

parsing, unifying, and passing to the local search engine on the application server results from the background job;

pushing local search results to the client;

indexing newly-provided data on the local search engine;

pushing newly-indexed data from remote sources to the client;

updating conditions for query and facets; and restarting the search of locally-stored information and the remote sources, in response to a user modifying at least one of one or more facets or search criteria.

* * * * *